US008870024B2

(12) United States Patent
Mendes et al.

(10) Patent No.: US 8,870,024 B2
(45) Date of Patent: Oct. 28, 2014

(54) DISPENSING APPARATUS

(75) Inventors: Tomas Antonio Dos Santos Mendes, Auckland (NZ); Kenneth Christie Hargraves, Auckland (NZ)

(73) Assignee: Durapod Systems Limited, Auckland (NZ)

( * ) Notice: Subject to any disclaimer, the term of this patent is extended or adjusted under 35 U.S.C. 154(b) by 1309 days.

(21) Appl. No.: 12/445,225

(22) PCT Filed: Oct. 11, 2007

(86) PCT No.: PCT/NZ2007/000302

§ 371 (c)(1), (2), (4) Date: May 3, 2010

(87) PCT Pub. No.: WO2008/044950

PCT Pub. Date: Apr. 17, 2008

(65) Prior Publication Data

US 2010/0282770 A1 Nov. 11, 2010

(30) Foreign Application Priority Data

Oct. 11, 2006 (NZ) ..... 550472

(51) Int. Cl.
*G07F 11/00* (2006.01)
*B65H 3/60* (2006.01)

(52) U.S. Cl.
USPC ..... 221/204; 221/282; 221/194; 221/205; 221/115; 221/165; 222/413; 222/353; 222/461; 222/344; 222/504; 222/196; 222/197; 222/167; 222/517; 222/163.14; 222/185.1; 222/152; 222/189.06; 222/129; 222/154; 222/155; 222/304; 222/363; 222/532; 222/185

(58) Field of Classification Search
USPC ..... 222/413, 353, 461, 344, 504, 196, 197, 222/167, 517, 163.14, 185.1, 152, 189.06, 222/129, 154, 155, 304, 363, 532, 185; 221/204, 115, 194, 106, 165, 205
See application file for complete search history.

(56) References Cited

U.S. PATENT DOCUMENTS

| | | | | | |
|---|---|---|---|---|---|
| 1,296,788 | A | * | 3/1919 | Frederick | 222/304 |
| 2,059,135 | A | * | 10/1936 | Moe | 222/165 |
| 2,977,023 | A | * | 3/1961 | Meyer | 221/205 |
| 3,926,289 | A | * | 12/1975 | Yoshioka et al. | 193/23 |

(Continued)

FOREIGN PATENT DOCUMENTS

| | | |
|---|---|---|
| FR | 2613701 | 10/1988 |
| GB | 410574 | 5/1934 |
| WO | WO 99/16338 | 4/1999 |

OTHER PUBLICATIONS

Derwent Abstract Accession No. 91-020422/03, SU 1564058 A1 (GEOR.POLY) May 15, 1990, See abstract and Figs. 1-3.

(Continued)

*Primary Examiner* — Rakesh Kumar
(74) *Attorney, Agent, or Firm* — Young & Thompson

(57) ABSTRACT

A dispensing apparatus for gravity feeding of a dispensable product includes containing means and dispensing means. The containing means is adapted to contain the dispensable product and is operatively connected to the dispensing means whereby the dispensing means includes a chute means. Rotation of the chute means can cause the dispensable product to be able to be dispensed.

19 Claims, 20 Drawing Sheets

(56) References Cited

U.S. PATENT DOCUMENTS

| | | | | | |
|---|---|---|---|---|---|
| 4,168,019 | A | | 9/1979 | Hausam | |
| 4,473,175 | A | * | 9/1984 | Zengaffinen et al. | 222/452 |
| 4,790,457 | A | * | 12/1988 | Morse et al. | 222/158 |
| 5,054,657 | A | * | 10/1991 | Morse et al. | 222/162 |
| 5,139,173 | A | * | 8/1992 | Evinger | 222/185.1 |
| 5,244,020 | A | * | 9/1993 | Bruno et al. | 141/83 |
| 5,375,737 | A | * | 12/1994 | Ficken | 221/194 |
| 5,437,393 | A | * | 8/1995 | Blicher et al. | 222/77 |
| 5,803,695 | A | * | 9/1998 | Schlagel | 414/301 |
| 5,967,334 | A | * | 10/1999 | Jackson et al. | 209/285 |
| 5,979,717 | A | * | 11/1999 | Dalton et al. | 222/532 |
| 6,091,028 | A | * | 7/2000 | Ozaki et al. | 177/1 |
| 6,182,864 | B1 | * | 2/2001 | Elmore | 222/129 |
| 6,581,511 | B2 | * | 6/2003 | Cusenza et al. | 99/357 |
| 6,981,619 | B2 | * | 1/2006 | Moretto | 222/353 |
| 7,137,729 | B2 | * | 11/2006 | Moretto | 366/141 |
| 7,461,763 | B1 | * | 12/2008 | Winn | 222/413 |
| 2004/0079767 | A1 | * | 4/2004 | Moretto | 222/413 |
| 2005/0269366 | A1 | | 12/2005 | Brundick et al. | |
| 2006/0266762 | A1 | * | 11/2006 | Andrews et al. | 221/45 |
| 2010/0282771 | A1 | * | 11/2010 | Auriol | 221/278 |

OTHER PUBLICATIONS

Supplementary Partial European Search Report dated Jul. 26, 2011 in corresponding European Patent Application No. 07860947.6.

* cited by examiner

DETAIL C

DISPENSING APPARATUS

The invention relates to a dispensing apparatus for bulk products. The invention is directed particularly but not solely towards a gravity dispensing bin for use with bulk products or any product capable of at least being dispensed.

BACKGROUND OF INVENTION

Dispensing products in bulk presents many problems not readily apparent when dealing with smaller volumes. Though any system being developed for large volumes can equally be used with smaller volumes, it is the economies of scale that tend to drive its creation and development.

Existing dispensing systems are difficult to use often requiring a two handed operation whereby a lever is moved while balancing a bag underneath to catch the product that may or may not drop into it. This aspect can put people off in using them, especially the elderly and children or those who are physically impaired. Any difficulties in operating such systems tend to cause product to be dropped on floors which adds to further product wastage. Any such floored product makes a mess which can be unsightly putting potential users off and in some instances the floor mess can be a physical and health hazard Some bulk food product dispensing apparatus merely rely on gravity to allow food to drop down to be dispensed however this does not always happen, requiring manual agitation or shaking/thumping of the dispenser. This means that damage to any such apparatus is very likely to occur. In some instances a mechanical form of agitation is used which itself may or may not work. Any form of agitation can sometimes be combined with a dispensing means and gate sealing. Adjusting or changing existing agitating means are generally only accessible by dismantling the dispensing apparatus. These agitating devices can be complicated and difficult to operate. Jamming problems further increase maintenance costs and can occur with the combined agitation gate means and handles, with the gate coming down to hit and jam against the food product that is dropping down by gravity or agitation.

To allow gravity to assist in the dispensing, these bulk feed apparatus are normally located in an elevated manner. Refilling any elevated container presents many problems of access and safety issues. Using ladders can add to any extra need for equipment plus its storage and present a hazard to the filling person and any user. Any movable bin on an extendable arm needs to be easy to move and able to extend to a convenient and safe height. In this specification unless the contrary is expressly stated, where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

OBJECT OF THE INVENTION

It is an object of the invention to provide a dispensing apparatus that ameliorates some of the disadvantages and limitations of the known art or at least to provide the public with a useful choice.

SUMMARY OF INVENTION

In a first aspect the invention resides in a dispensing apparatus for gravity feeding of a dispensable product whereby the apparatus includes a non rotating containing and dispensing means wherein the containing means is adapted to contain the dispensable product and is operatively connected to a dispensing means whereby the dispensing means includes a chute means whereby rotation of the chute means only can cause the dispensable product to be able to be dispensed, from the containing means, wherein the chute means is biasedly attached to the containing means to allow the chute means to automatically return to a closed position after being used to dispense product therefrom.

Preferably, the chute means is operatively connected to a gate means, the chute means includes a first rotating means to allow the rotation of the chute means with respect to the containing means, a second rotating means comprising a toothed wheel being located above the first rotating means and being rotationally affixed to the container, the chute means and gate means, and only able to allow rotation of a fixed distance whereby in use rotation of the chute means about the first rotating means such that the gate means moves a set distance to open or close the dispensing means to allow dispensing or not.

Preferably, the gate means has a curved base portion and is rotatably mounted to the chute means whereby in use the base portion of the gate means slidably moves past a similarly curved portion of the chute means to allow opening and closing of the chute means.

Preferably, an agitating means is adapted to move and assist the dispensable contents to move when the dispensing means is being activated or operated.

Preferably, the agitating means comprises adjustable arm means being located externally to the containing means whereby the agitating means can made to move upwards or downwards.

Preferably, the apparatus includes an extending means being operatively connected and adapted to allow the apparatus to be moved to allow refilling or dispensing therefrom.

Preferably, the extending means comprises moveably rotatably connected and foldable arms which are connected to a supporting means whereby the supporting means is connected to the container.

BRIEF DESCRIPTION

The invention will now be described, by way of example only, by reference to the accompanying drawings.

DESCRIPTION OF THE INVENTION

Figure 1:
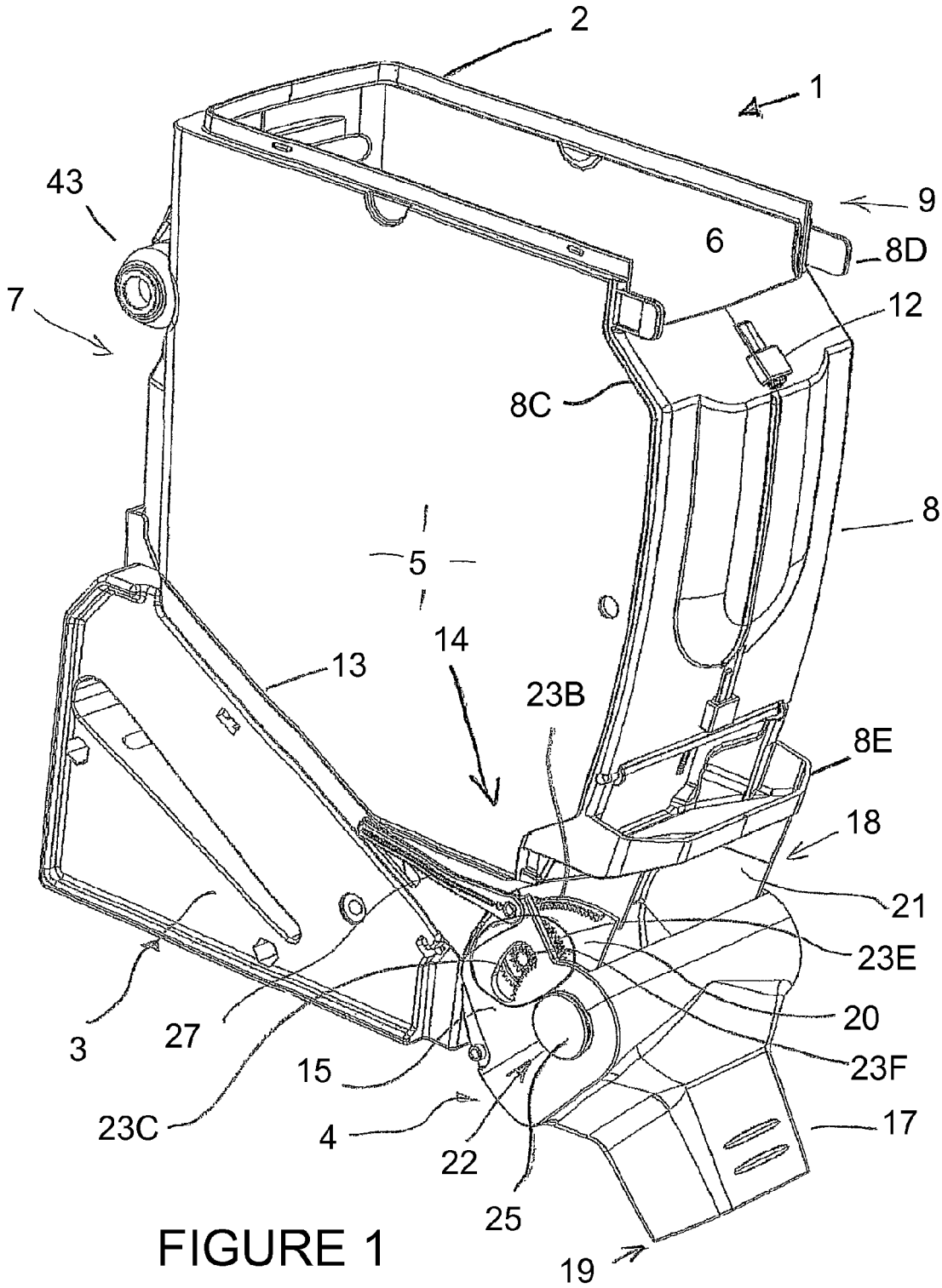
FIG. 1 is a perspective view of the dispensing apparatus without the lid and front panel portion.

The following description will describe the invention in relation to preferred embodiments of the invention, namely a dispensing apparatus 1 for dispensing any materials such as for example cereals and nuts. The invention is in no way limited to these preferred embodiments as they are purely to exemplify the invention only and that possible variations and modifications would be readily apparent without departing from the scope of the invention. FIGS. 1-7 show a first version or embodiment of the invention while FIGS. 8-20 show a second embodiment mainly shown more details of previously disclosed components but also showing a stop or lock means to lock and prevent the use of the invention with both versions using mostly the same components with some variation or improvement as described. As shown by the various arrows in most of the figures parts of the dispensing apparatus like the chute means and the container can rotate in that general direction during use.

As shown in FIGS. 1-7 and 8, 11, 13, 13A-13C, 14, 14-14B-20 dispensing apparatus 1 includes the following components of containing means 2 which is supportively connected to container support means 3. Containing means 2 is shaped to hold any contents or product which can be dispensed thus forming an enclosed space having an inner surface and an outer surface external to said enclosed space. A dispensing means 4 is operatively connected to containing means 2 such that any contents contained therein can be dispensed therefrom.

In use containing means 2 can be termed a container having sides 5 & 6, rear end 7, front end 8, an upper portion 9 and lower portion 10. Containing means 2 can also have a lid 11 though not shown in FIG. 1 which can be a separate item or be operatively connected to or be removable or non removable and be able to seal in a suitable manner such as to be air tight, easy to use and be secure if required.

Front end 8 with respect to a user of the dispensing apparatus, can comprise an inner space 8A and an outer portion 8B. The inner space 8A can be formed as an enclosed or open housing which functions to provide a cover to the dispensing end whereby any dispensed or contained product is not able to block or cover or get in between the moving surfaces when operating the dispenser. Additionally this housing can include any shape that further enhances or encourages the dispensing product to drop towards the dispensing end. The outer portion 8B which can be approximately U shaped profile with the arms of the U shape being removably attachable via lapped stepped longitudinal edges 8C and locking tabs 8D. Also shown in the figures without the front panel portion 8B is front panel support member 8E.

Figure 8:
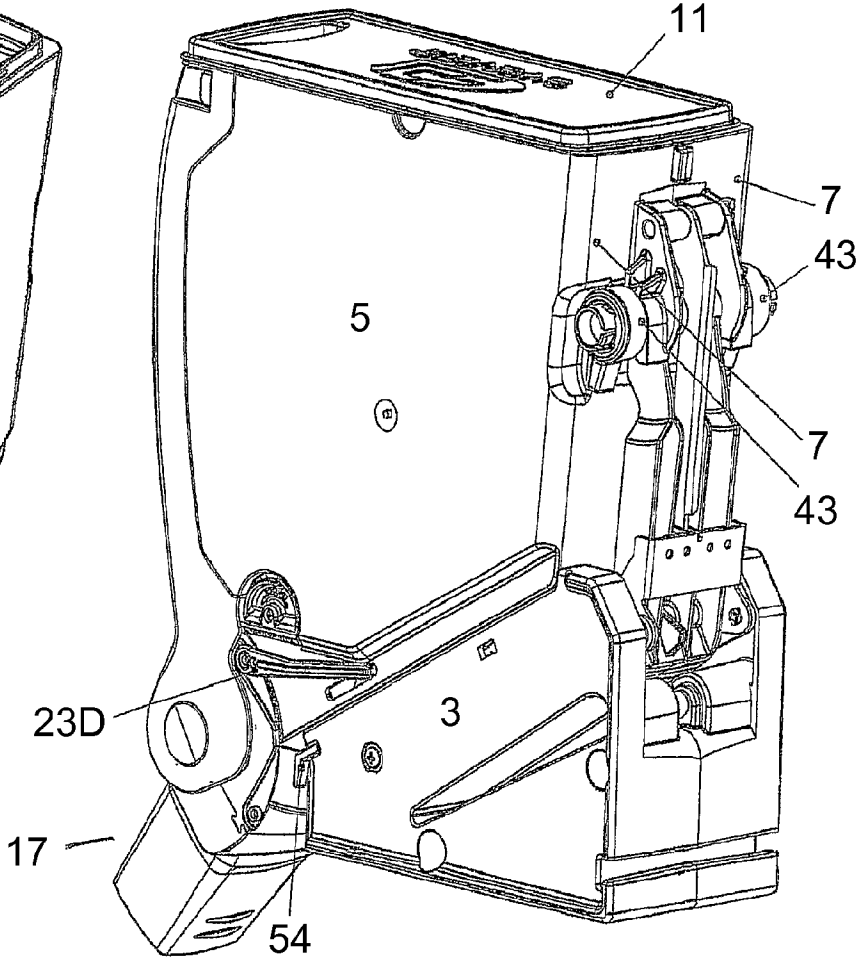
FIG. 8 is a perspective rear side view of the apparatus of FIG. 8 but with the chute.
Figure 9:
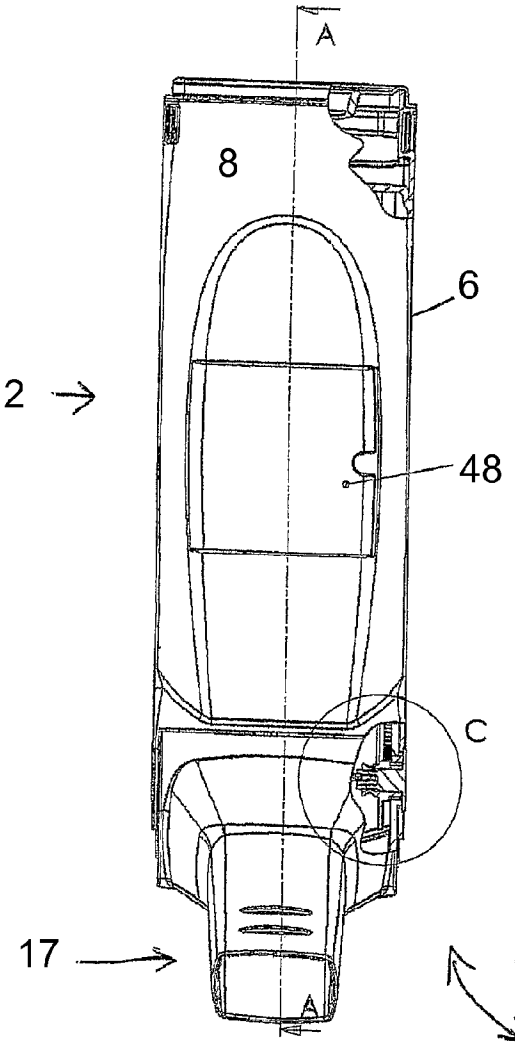
FIG. 9 is an end elevation of the apparatus of FIG. 8.

Additionally the components of the dispensing apparatus 1 are connected so as to allow optional disassembly for maintenance (repairing and cleaning), transportation, filling and manufacture or construction. Container 2 is also shaped and connected to allow disassembly whereby for example as shown container 2 comprises two vertical halves removably connected together via connection means 12 which in this example comprise clips and tab arrangement as shown in FIGS. 1, 8 and 9. As shown in the figures there are various covers or housings which though not shown in all the figures, can be added to various portions of the apparatus to provide a better cleaning surface, protect any mechanical working parts and generally make the apparatus look more aesthetic and safer.

Base 10 can be shaped in any way that assists in the apparatus to be mounted and/or assists the gravity feeding of the container contents. For example base 10 can be shaped to provide an angled portion 13 leading to a front end open corner portion 14 having downwardly extending container tab portions 15 & 16. Alternatively any angled portion can be located anywhere on the base. The angled portion 13 is shaped to allow the contained product to more easily move downwards while being stored and when being removed substantially by gravity and optionally can be shaped to allow container supporting means 3 to abut therewith. In yet other options, the container itself can be shaped as a whole to assist gravity to force the contents down when required e.g. it could be funnel shaped with a central exit chute. In yet another variation, the base 10 of container 2 can be shaped to sit flat or be stable on any support surface but have within, a downwardly angled surface or baffles or ramps to assist in the downward feeding of contents or material.

Dispensing means 4 includes a chute means 17 being generally tubular having ends and sides with entry end 18 and exit end 19 with respect to the material or product to be contained and then dispensed as required. The chute entry end has substantially oriented upwardly flared or extending chute side tab portions 20 & 21. Adjacent to entry end 18 which is rotatably joined and connectively supported by first rotating means 22 to the downwardly extending container side tab portions 15 & 16 located at or adjacent to the lowest point of the base of the container 2 at front end corner portion 14. In this example the entry end 18 can be a larger diameter or cross section leading to a smaller diameter or cross section at the exit end 19.

Figure 12:
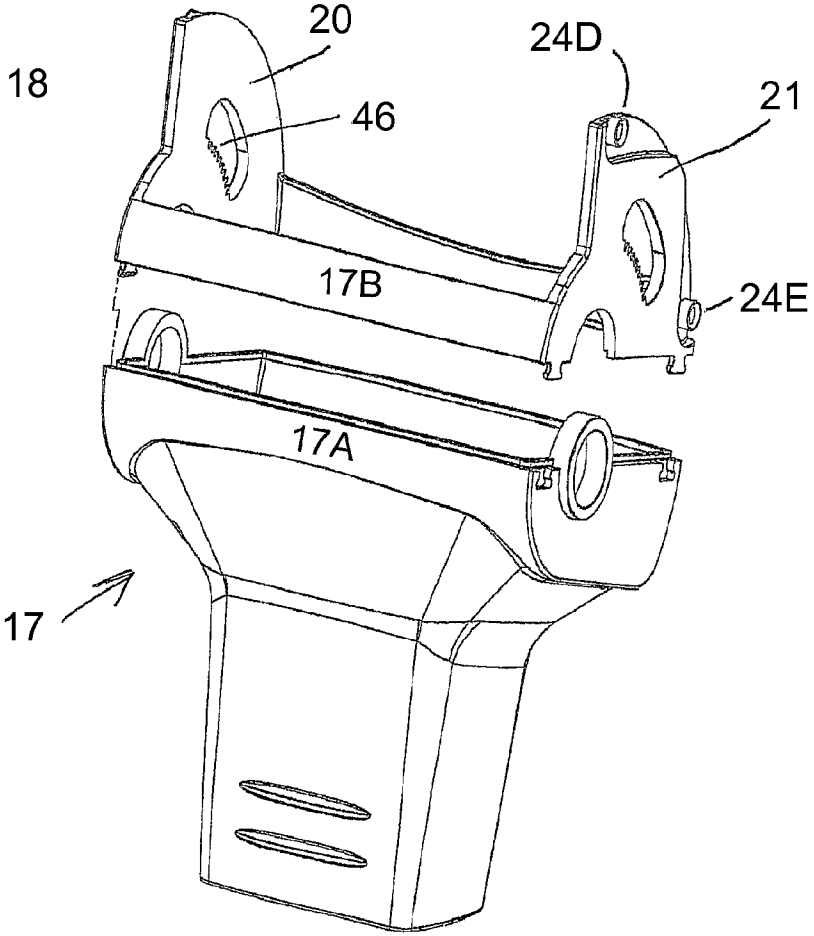
FIG. 12 is a perspective front side view of the cute of FIG. 12.
Figure 11:
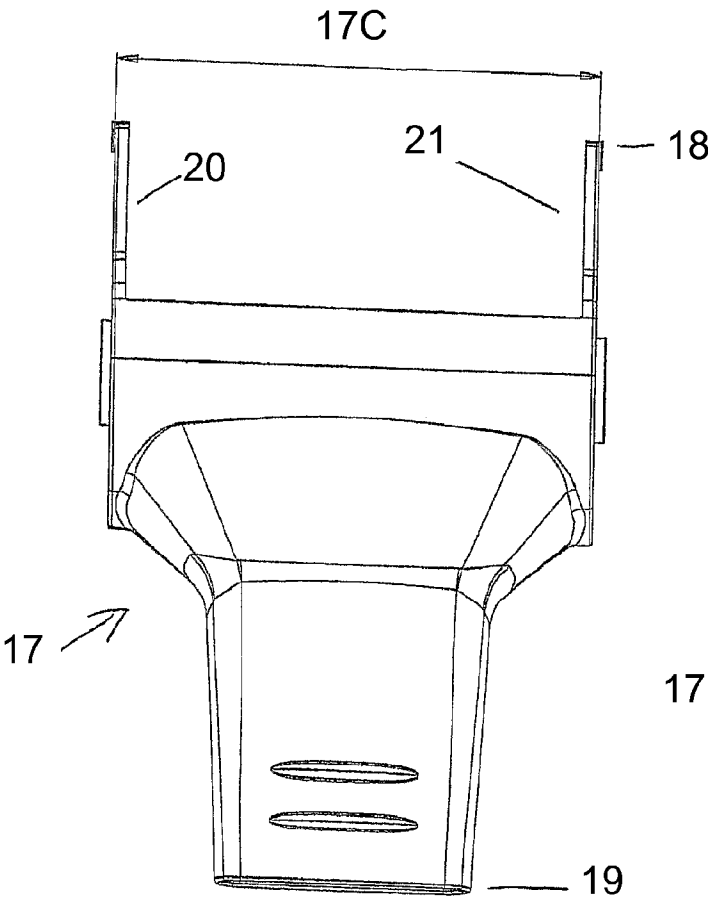
FIG. 11 is a front end view of the chute.
Figure 13:
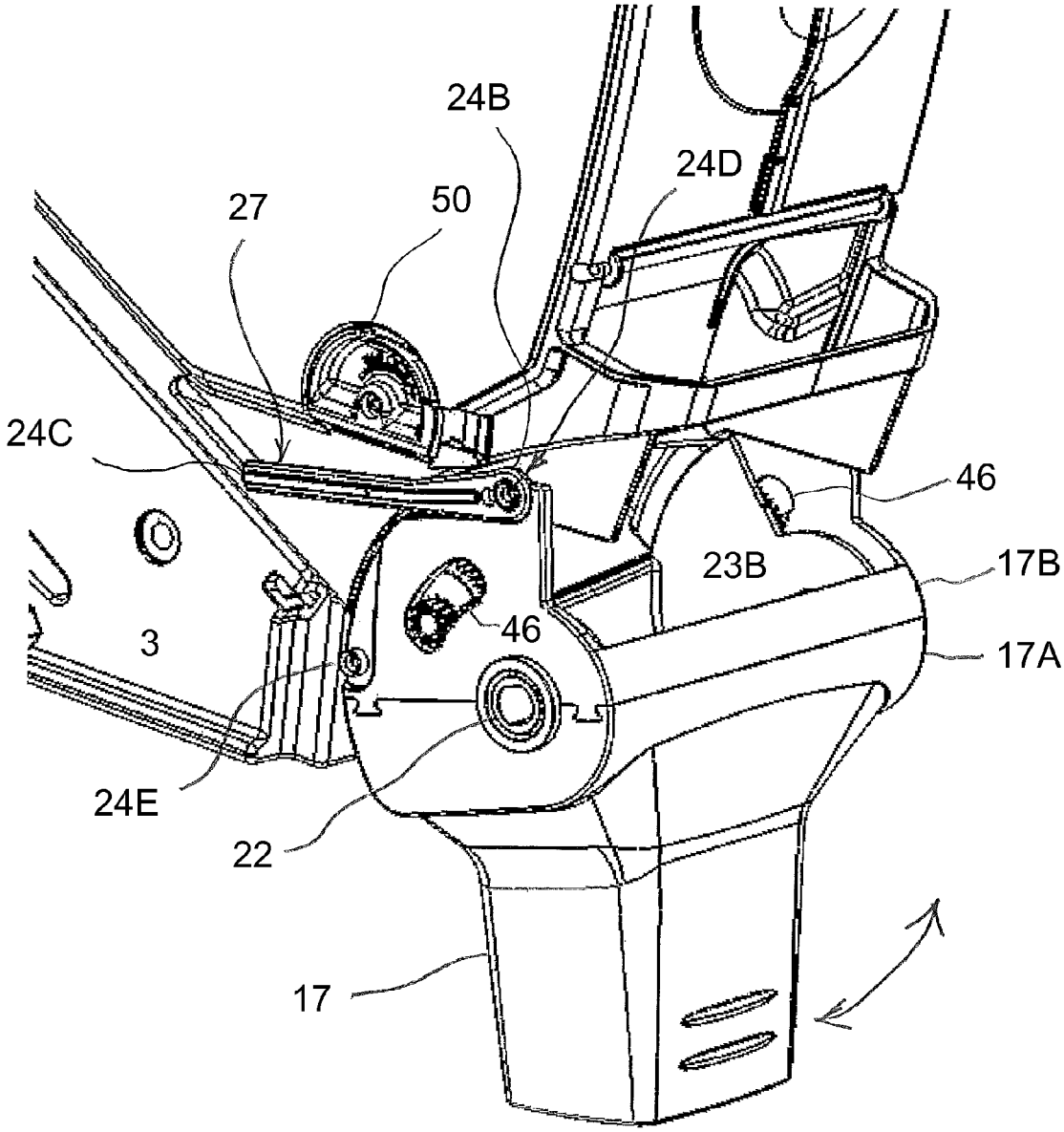
FIG. 13 is a close up side view of the chute in the open position without the container tabs.
Figure 13A:
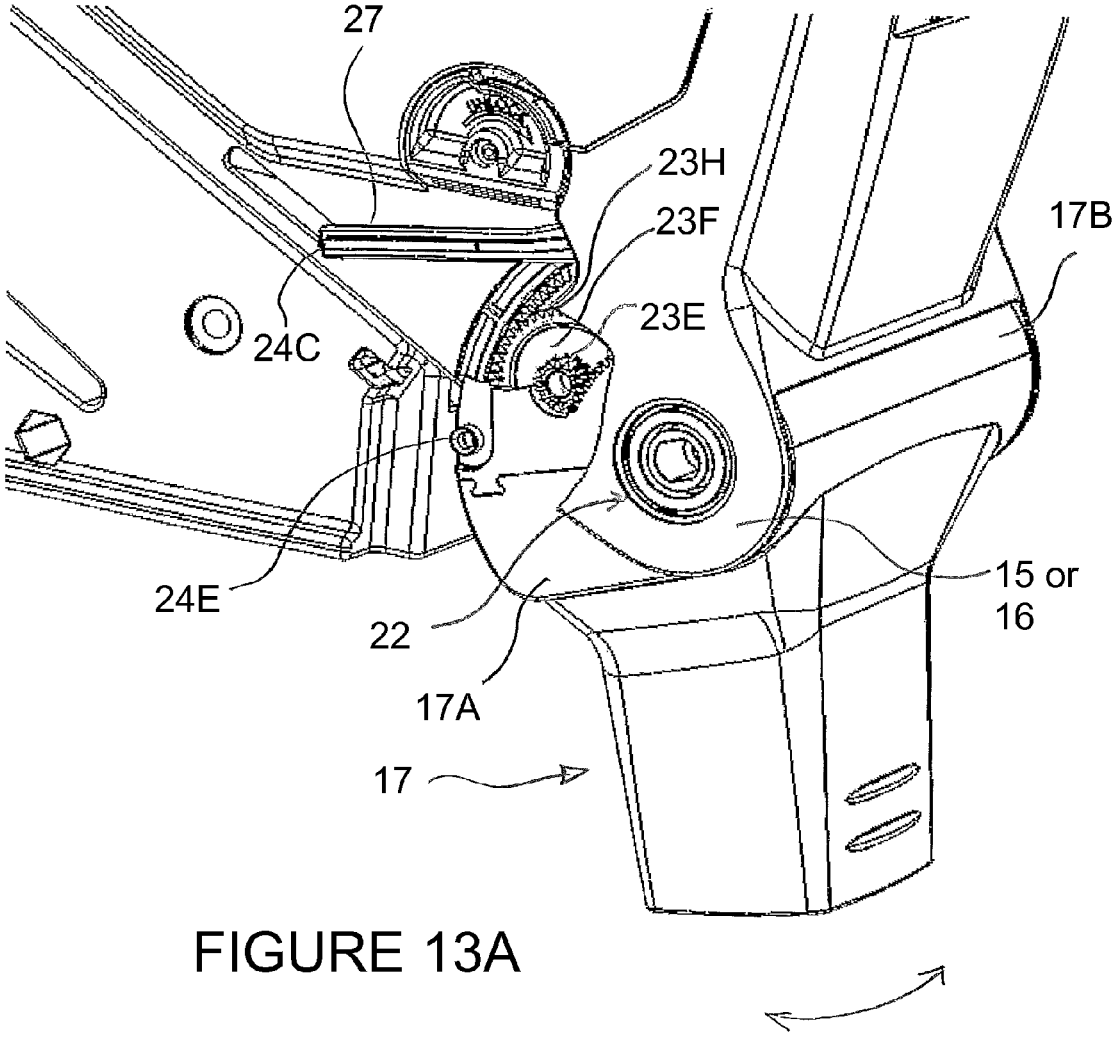
FIG. 13A is a close up front perspective view of the chute mechanism in an open position and without the container tabs.
Figure 13B:
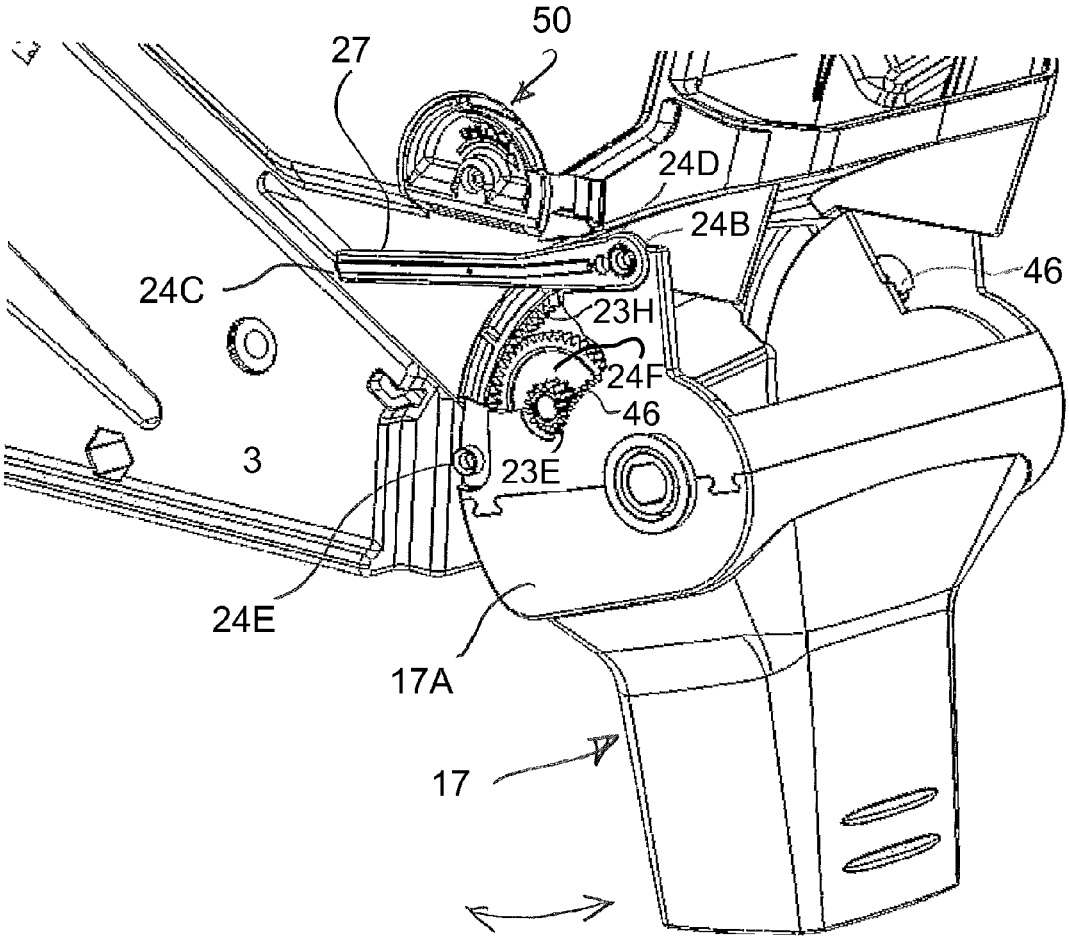
FIG. 13B is a close up front perspective view of the chute mechanism in an open position and with the container tabs.
Figure 13C:
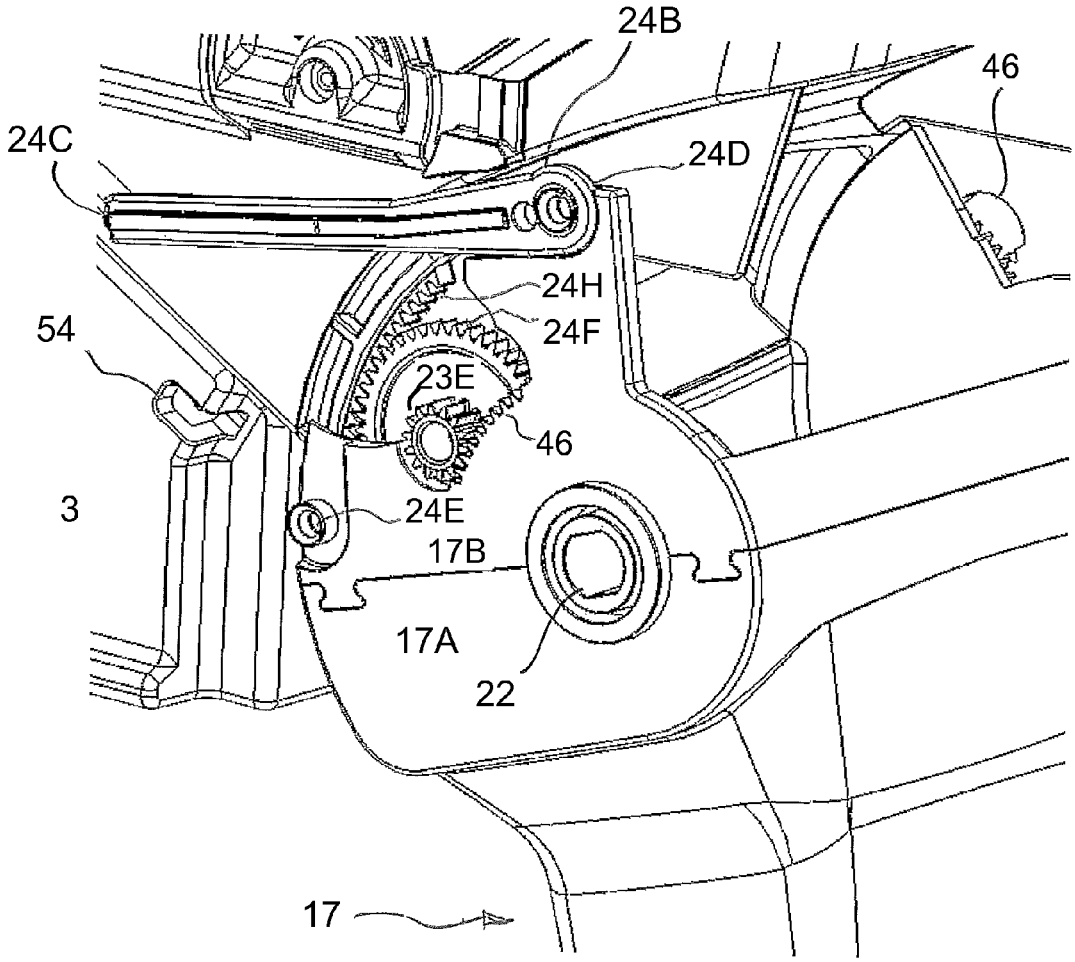
FIG. 13C is a close up front perspective view similar to FIG. 13A of the chute mechanism in an open position and without the container tabs.
Figure 14:
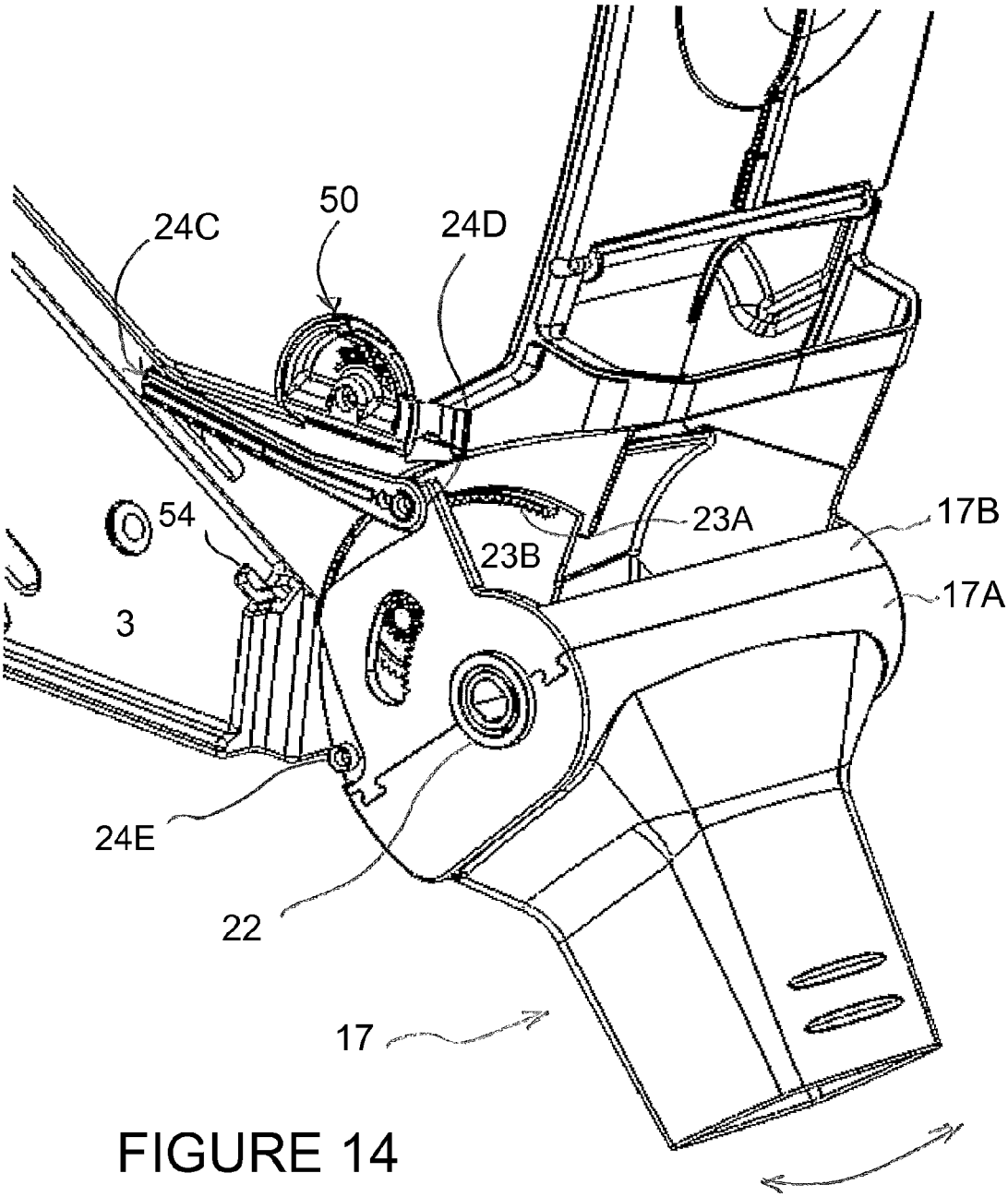
FIG. 14 is a close up side view of the chute mechanism in a closed position without the container tabs.
Figure 14A:
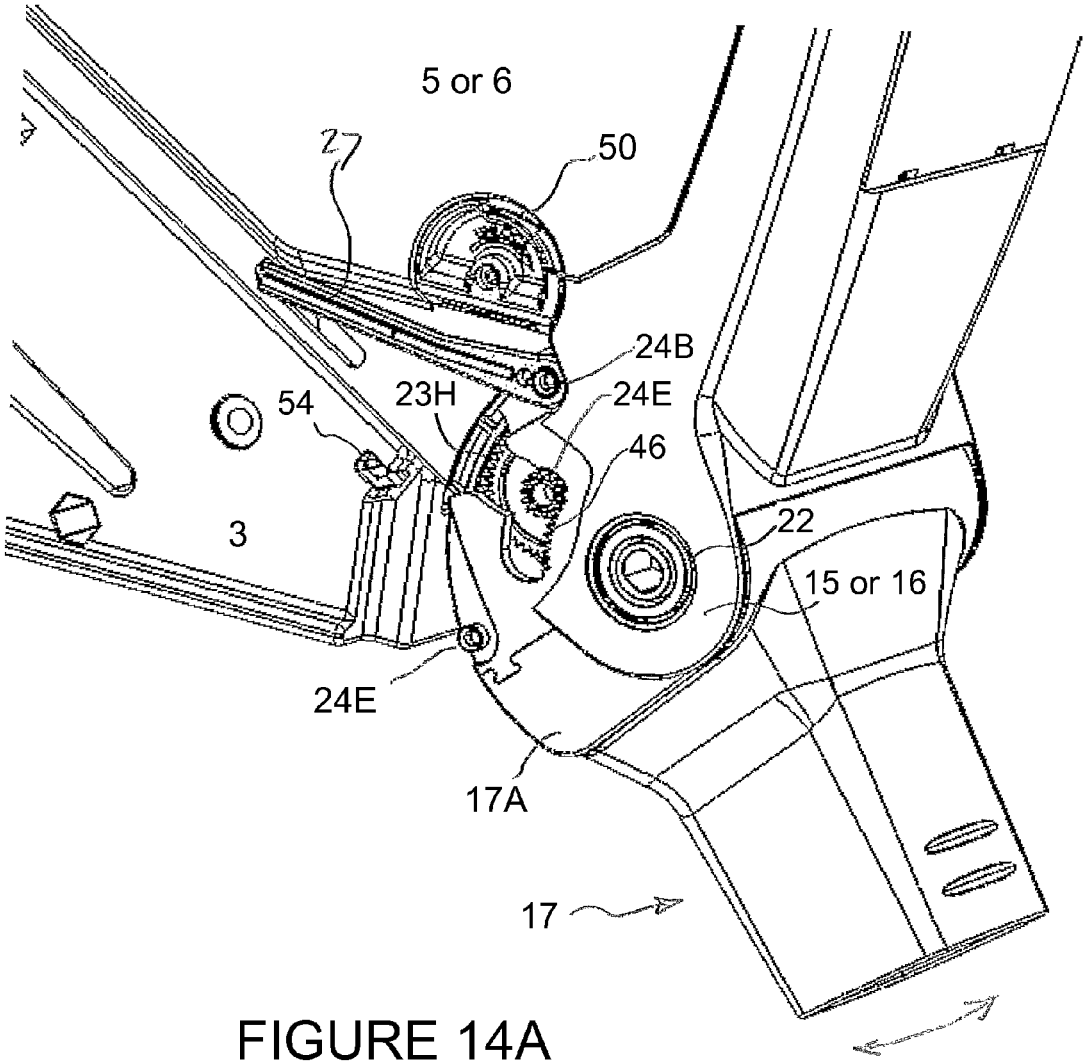
FIG. 14A is a close up side view of the chute mechanism in a closed position with the container tabs.
Figure 14B:
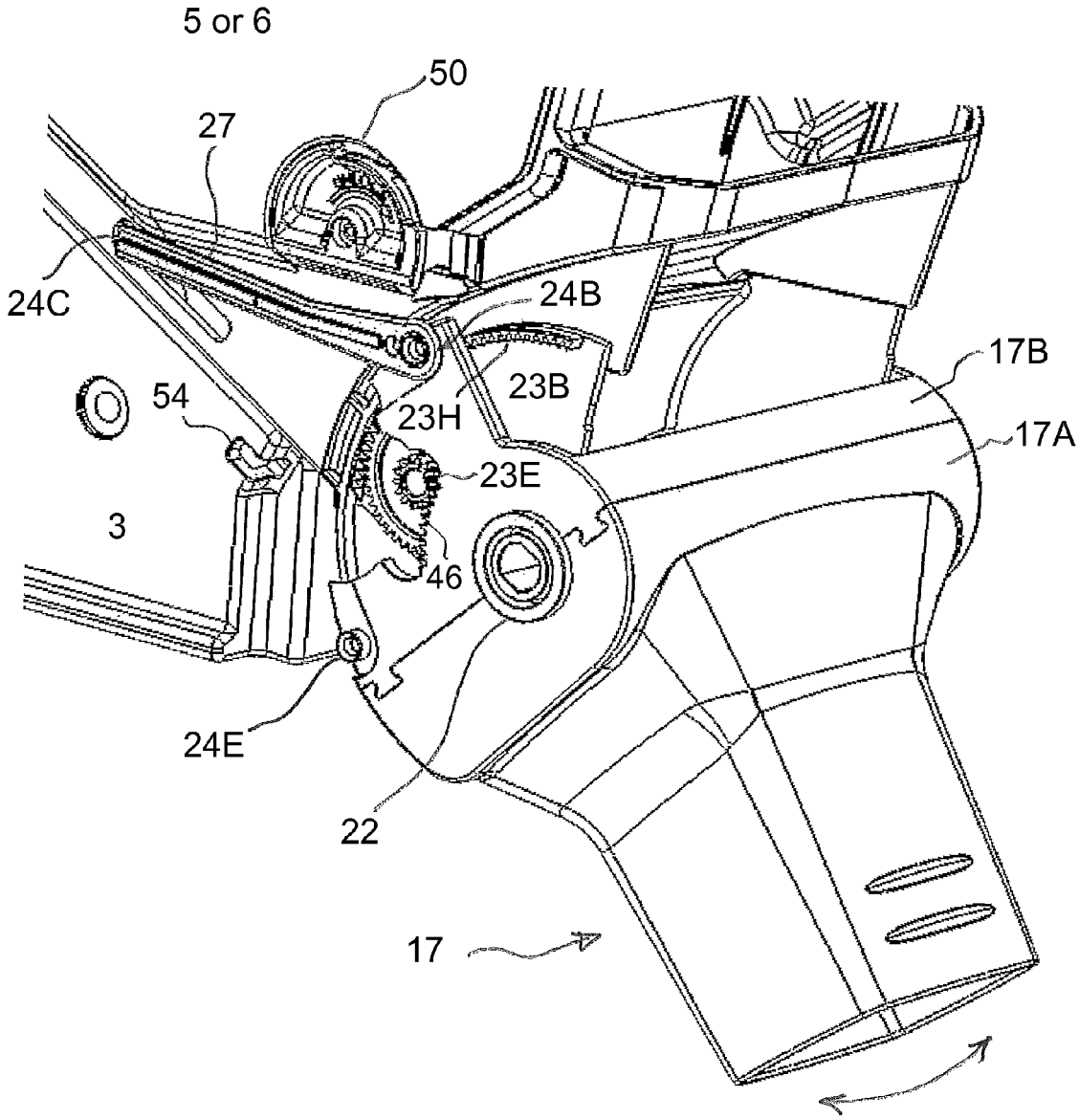
FIG. 14B is a close up side view similar to FIG. 14A but with more of the chute mechanism shown while sill in a closed position without the container tabs.

Chute means 17 as shown in detail in FIGS. 11 and 12, is substantially tubular in shape having in use a lower surface and an upper surface with or without sides to form the tubular shape to allow the exit of the contained product. The tubular cross sectional shape of the chute can be rectangular or square or angular or circular or any suitable shape length and size that allows merely for the channelling of product to be dispensed to the consumer. Operatively connected to and within or adjacent to chute means 17, is a trap door or gate means 23 and within the container enclosed space and operatively connected to the chute means 17, is agitating means 24.

Figure 15:
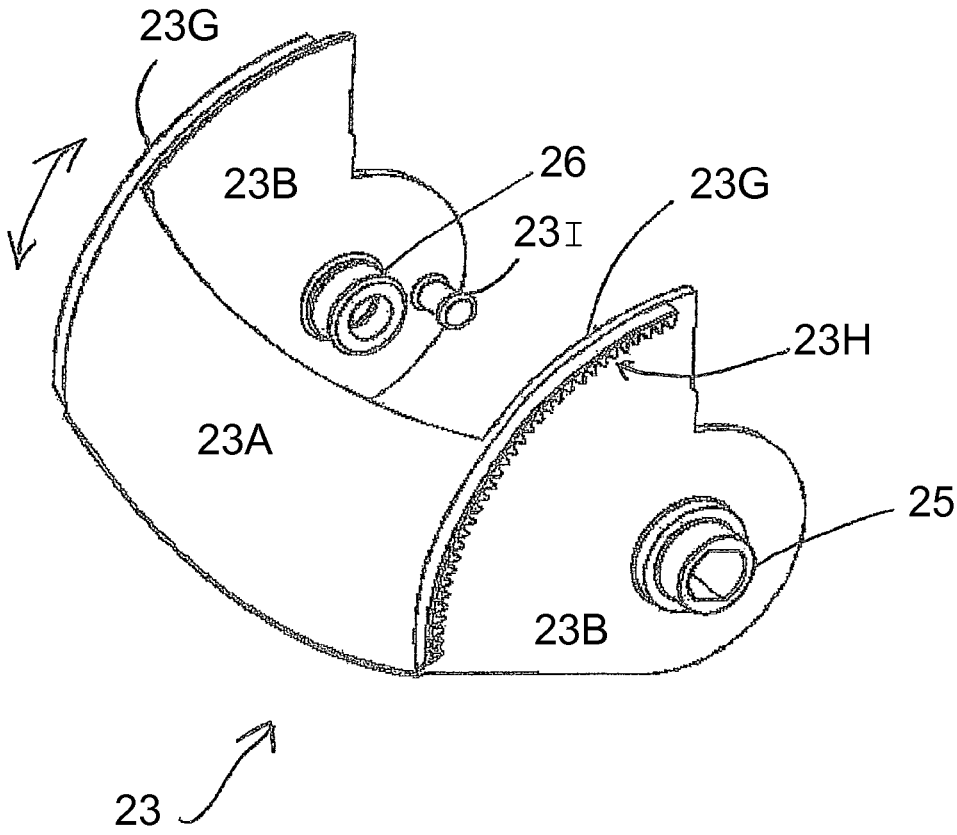
FIG. 15 is a close up cross sectional view of the main rotation point of the chute.

Gate means 23 as shown in detail in FIG. 15, can be shaped as a substantially U-shaped or channel shaped member having a base 23A and arms 23B whereby the arms in use to rotatably by a second rotating means 23C, movably fix and support gate means 23 to the chute means 17 and container 2 to move in a set synchronized way as required. The base 23A forms the gate to block the entry end 18 of the chute means 17. In use the gate arms 23B which extend at substantially at right angles to the base, are slidably abutting and are rotationally connected to the chute means tabs 20 and 21 and container tabs 15 and 16.

In use chute means 17 is shaped to provide a downwardly open tubular portion or funnelling means. For example the cross section can be a cross section that is dimensioned to match the base of the container and cause the contents to move to an exit aperture be moveable or rotatable while maintaining a sealing containment of the contents at all times. The shape of chute means 17 can be any shape that is connectable in a dispensing sense to the container 2 and can be for example any variation of cross section that assists the dispensable product to be dispensed. The first rotating means 22 includes pivot means 25 & 26 on each side of the open corner portion 14 whereby corner portion 14 which includes in use the downwardly extending tab portions 15 and 16 which rotatably connect or inter-fit with pivot means 25 and 26.

First rotating means 22 can optionally include biasing means 23D which includes any means that enables the chute portion 17 to automatically return to a closed position (which may be an upwards position) after use and/or allow for the coordinated movement of the gate means 23 and chute means 17 to close as well. For example the second rotating means 23C and/or biasing means 23D can include one or two spring or sprung or tensioned elongate members which when appropriately removably fixed and then deformed, can move the chute means 17 accordingly. The biasing means 23D can be operatively connected to the chute means 17 and gate means 23. The second rotating means 23C and biasing means 23D can include the same shaped member as the biasing means 23D and can be located for example within chute means 17.

The biasing means can be in the form of an elongate flexible resilient member which can be moved in tension and then be allowed to relax automatically back to its original position thereby allowing in use the chute means 17 to be rotated about the rotating means 22 to cause the gate means 23 to be moved against the force of the biasing means and also able to automatically return to its original position. For the biasing means 23D one end (e.g. an upper end) can be located and fixed to the lower end of the container 2 and the other end (e.g. lower end) of the biasing means 23D can be removably located on each gate arm(s) 23B on a protruding pin member 231 (pin member 23 is shown in FIG. 15) of the gate means 23. A non end portion of the biasing means 23D is movably slidably located on piyot means 25 & 26 or rotating means 22, to allow controlled rotation there around. Each fixing end of the biasing means can comprise a looped end.

Gate means 23 is located substantially at or near the entry end of chute means 17 and includes a surface which can be shaped as part of a planar portion extending from the lower chute surface and is shaped and oriented and rotatably and connectively supported via second rotating means 23C such that rotation of the chute means 17 causes gate means 23 to move whereby it can substantially close or cover the exit end 19 to prevent the removal or dispensing of the contained product.

In assembly the gate arms 23B for each side, slidably and rotatably interfit within each of the chute tabs 20 & 21 which in turn are slidably and rotatably located with the container tabs 15 & 16 and rotating means whereby in use the container tabs 15 and 16 are located on the outermost sides to face a user.

In another option the agitating means 24 can also be operatively connected to chute means 17 such that rotation or movement of the chute means 17 causes the agitation means to move. Agitating means 24 can be in the form of a planar ribbed member 24A which is located inside container 2 on its lower surface to be positioned under any contained material or product and has a shape when covered by the contained product, is able to agitate or move or shake the product when it is slidably moved. This movement can assist in dislodging any stuck product and or allowing it to move more quickly down with gravity, through the chute when required. This movement can include translational sliding movement on the base of the container which can be synchronized with the movement of the gate means 23. Agitating means 24 is movably connected to chute means 17 by agitating moving means such as agitating arm means 27 and 28 removably or adjustably connected to the upper end of the chute means 17 on the outside of the container. Though in this example two arm means are shown only can also be used. This location of the arm means allows for easy and quick adjustment of the agitating means whereby each arm 27 or 28 can be simply repositioned on the chute means tabs 20 and/or 21. This positioning of the arms and their removable connection allows for very easy adjustment or repositioning without dismantling any of the dispensing apparatus. Just lift out one end and shift across.

This can be seen in FIGS. 12 and 13, 13A-13C & 14, 14A and 14B. Arms 27 or 28 can be formed as elongate strip like members made of plastics or any other material, having one end 24B connectable to the chute tab 20 or 21 and the other end 24C connectable to the agitating means 24. As shown in FIG. 12 there are arm connecting means 24D and 24E having an end rib. There can be any number of these connection means points as required. In other options there may be other positions on the agitating means 24. End 24B which is connectable to the chute tab 20 or 21 is formed with a protruding pin member, which in use is insertable into the planar ribbed member 24A of the agitating means. These components can be attached in other ways as long it allows the planar member 24A to slidably move as required. End 24C can be formed as an eyelet or loop which can in use be frictionally slidably fitted over the rib of connecting means 24D or 24E to hold each arm end thereon.

It should be noted that the position of the arm 27 or 28 is shown in the drawings is in the upper tab connection means 24D which means that the planar member 24A is located at the top of the sloping base which means that in operation when the chute is rotated to open the gate means, the planar member slides down and then goes back up when the chute is allowed to return to its closed position. Changing the position of the arm end to 24E simply swaps this sliding movement of the planar member 24A to being sliding upwards and then down, or from a pulling down action to a pushing up action. Connection means 24D is not easily seen in the drawings but is hidden from view behind.

In one example if the chute means 17 is in the closed state whereby no product can exit the container this means that the gate means 23 is in the closed state blocking the chute and the agitation means is in a lower position on the container base. This orientation of the agitation means can be altered as required. To operate the dispensing means chute means 17 is then rotated in a downward clockwise direction which then causes the gate means 23 to open by moving downwards and at the same time the agitating means 24 also downwardly moves in a first movement to agitate the contained product whereby the product exits the container 2. This means that the agitating arm means 27 and 28 are removably fixed to the upper distal end of the chute means 17. After using the chute means 17 to remove some product, to close the dispenser, the user can simply allow the chute to automatically return it original position or rotate the chute means 17 in the opposite direction for example in this case in the anticlockwise direction e.g. upwards whereby the gate means goes up to close the opening and the agitation means can optionally also go back in the opposite direction to its first movement, i.e. in the downwards direction on the base 13.

In other options the agitating means 24 need not be coordinated in its movement or operation with the chute means 17. For example agitating means 24 could be simply operated in a separate manner. Also the closing of the dispenser can also be achieved automatically by being automatically returning to a closed position with the biasing means operatively connected to the rotating means 22.

In yet another option for the operation of the gate means 23 and agitating means 24 if the agitating arm means 27 and 28 is/are removably affixed to a different position on the tabs of the chute means 17 like for example a lower end adjacent the first rotating means 22, then when the chute means 17 is rotated downwards (to open the gate means), this causes the agitating means 24 to be located at the lowest end of the base 13 of the container such that rotation of the chute means 17 causes the gate means 23 to rotate downwards or open and the agitating means 24 to travel up the base 13. Other arm positions are equally possible to also allow different positioning of the agitating means 24 on the base 13.

Figure 2:
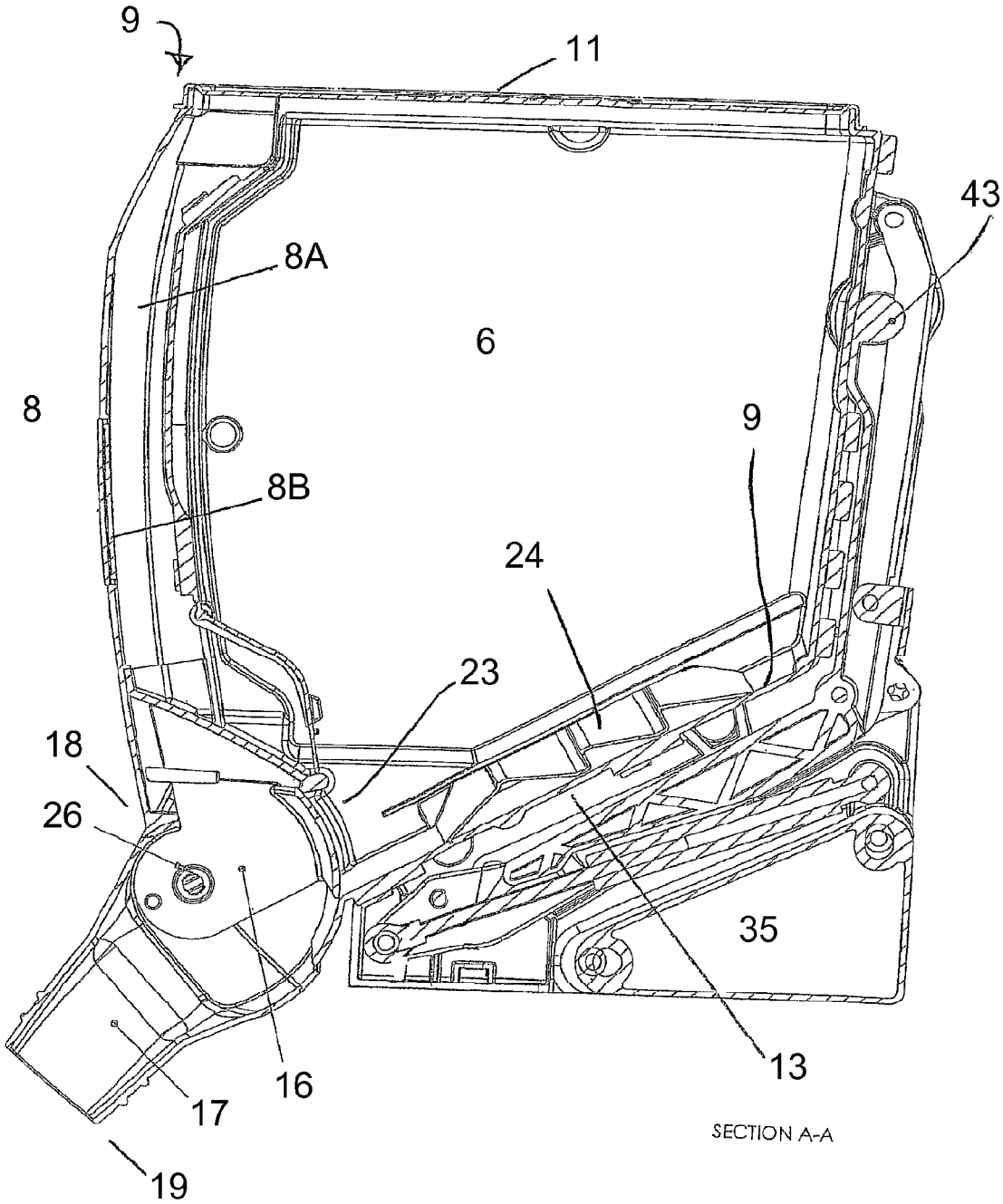
FIG. 2 is a side view of the dispensing apparatus of FIG. 1 but with the lid and front panel portion.
Figure 3:
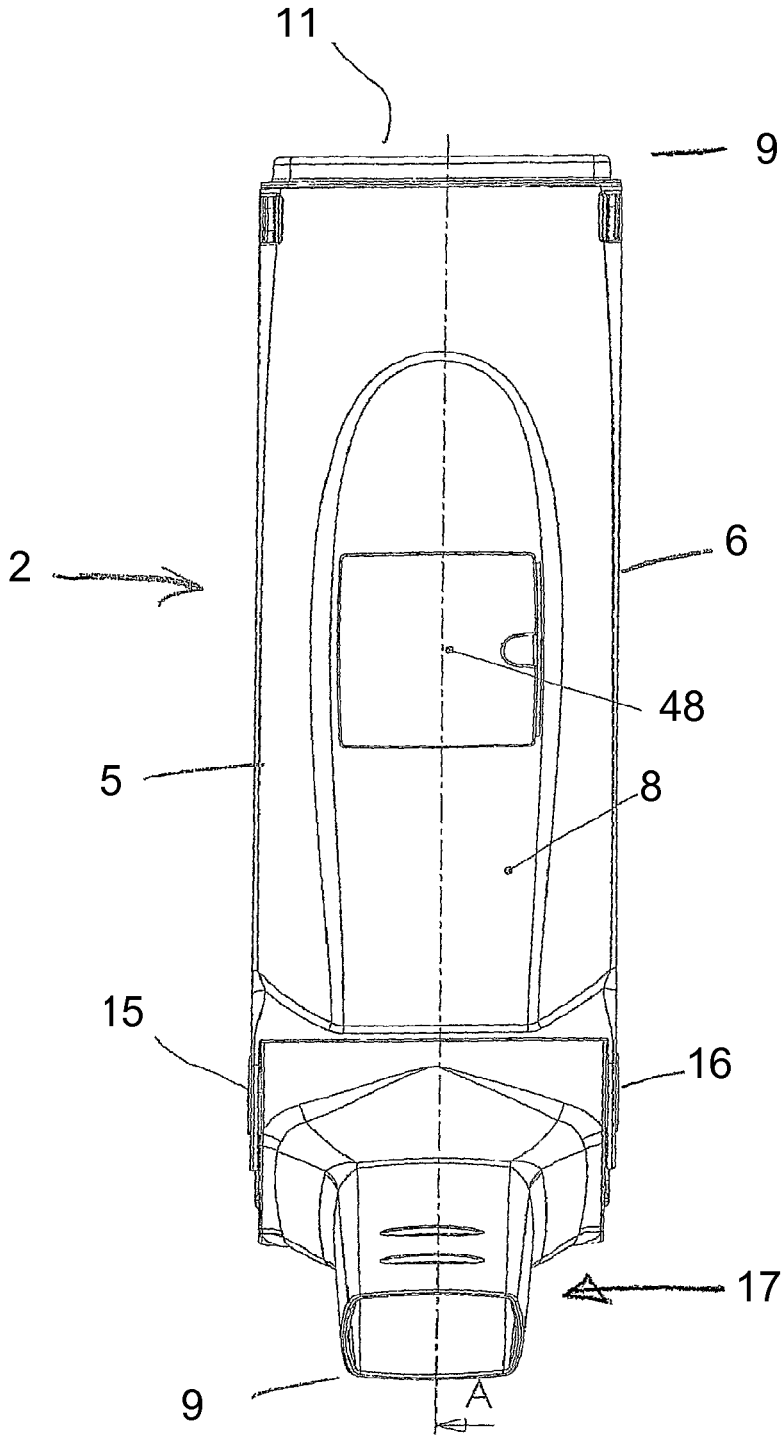
FIG. 3 is a front end view of the dispensing apparatus.
Figure 4:
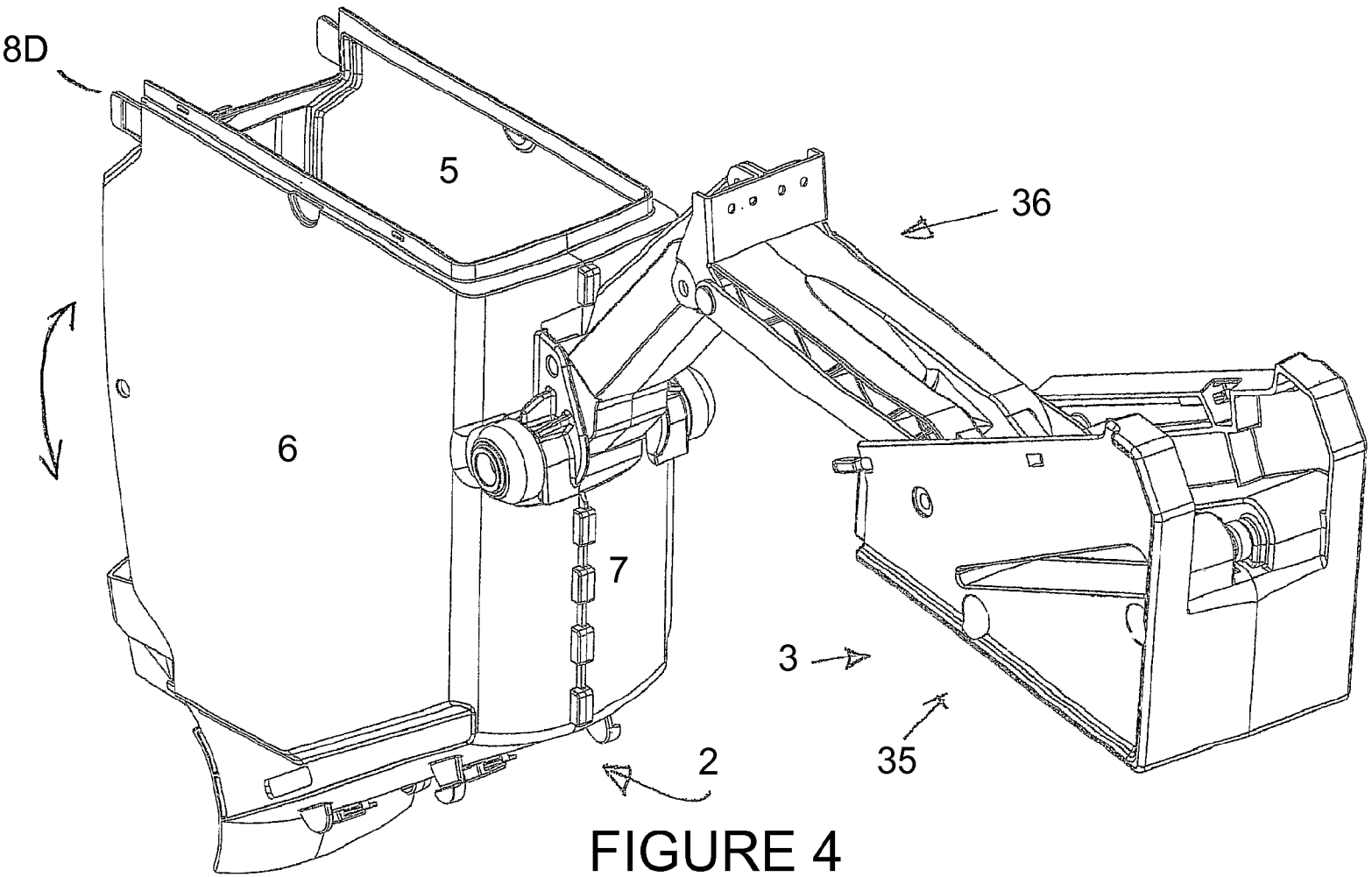
FIG. 4 is an upper perspective view of the dispensing apparatus in an extended mode for refilling without the lid and front portion.

As shown in the drawings, rotational connection between the dispensing means 4 and the container 2 and/or agitating means 24 can vary in that a cogged or tooth mating surfaces as in FIGS. 1 and 2 can be used to transfer rotational movement from the chute means 17 to the gate means and optionally the agitating means 24. Also the spatial arrangement of the various tabs can be swapped around e.g. the chute tabs 20 and 21 can be placed on the outer surface rather than the container tabs 15 and 16.

Second rotating means 23C includes any operatively connected system joined to the first rotating means 22 whereby rotation of the chute means 17 about first rotating means 22 causes a predetermined rotation of the gate arms 23B and base 23A of the gate means 17, to present an opening for the contained material contained above to fall into. In this example second rotating means 23C includes a rotating activating support means from rotating means 22 which is rotatable connected and driven at an in use upper angled position rotational point on each arm whereby this second rotational point comprises a toothed or geared wheel. Each toothed wheel 23C is located between one container tab 15 or 16 and gate arm 23B but is rotationally fixed to one container tab 15 or 16 with the container tabs 15 or 16 being the most outer followed by the chute tabs and then the gate arms 23B being the most inner.

The toothed wheel 23C includes an inner toothed wheel portion 23E and an outer toothed wheel portion 23F formed together. Though in this example the toothed wheel is shown as a one piece member other means of achieving the same result are possible such as by using two separate wheels. The inner toothed wheel 23E has a larger diameter than the outer tooth wheel 23F so that when being rotated by rotation of the chute means 17 which causes proportional rotational movement of the gate means 17.

The smaller toothed wheel 23E is rotationally supported by one container tab 15 or 16 on each side of the container which such chute tab has a curved slot 46 which moves around the smaller toothed wheel 23E (i.e. the chute is rotated) is able to move within a slotted aperture in the chute tabs 20 & 21 thereby restricting the rotation of the chute tabs 20 & 21 and gate arms 23B. The slotted aperture 46 is a curved slot shaped like a banana, having serrations that mate with the teeth of the smaller toothed wheel. The curved extent of the chute tab slot 46 determines the extent of rotation of the chute and movement of the gate means 23. Large toothed wheel 23F almost abuts on its side with the outer side of the gate arms 23B. Gate arms 23B have curved outer edge 23G with an outwardly extending lip or overhanging edge having downwardly extending serrations or teeth 23H which inter mesh with the outwardly extending teeth or serrations of the large toothed wheel 23F.

In operation, movement of the chute means 17 about the first rotating means 22, moves the large toothed wheel 23F which moves the gate arms 23B a set distance as determined by the rotation of the small wheel 23E. During this rotation the gate base 23A is curved in shape which matches the same curved shaped of the entry end 18 of the chute means 17 so that during rotation of the chute means 17, the gate base 23A is able to slidably move past and inside the entry end 18 of the chute means 17.

Figure 16:
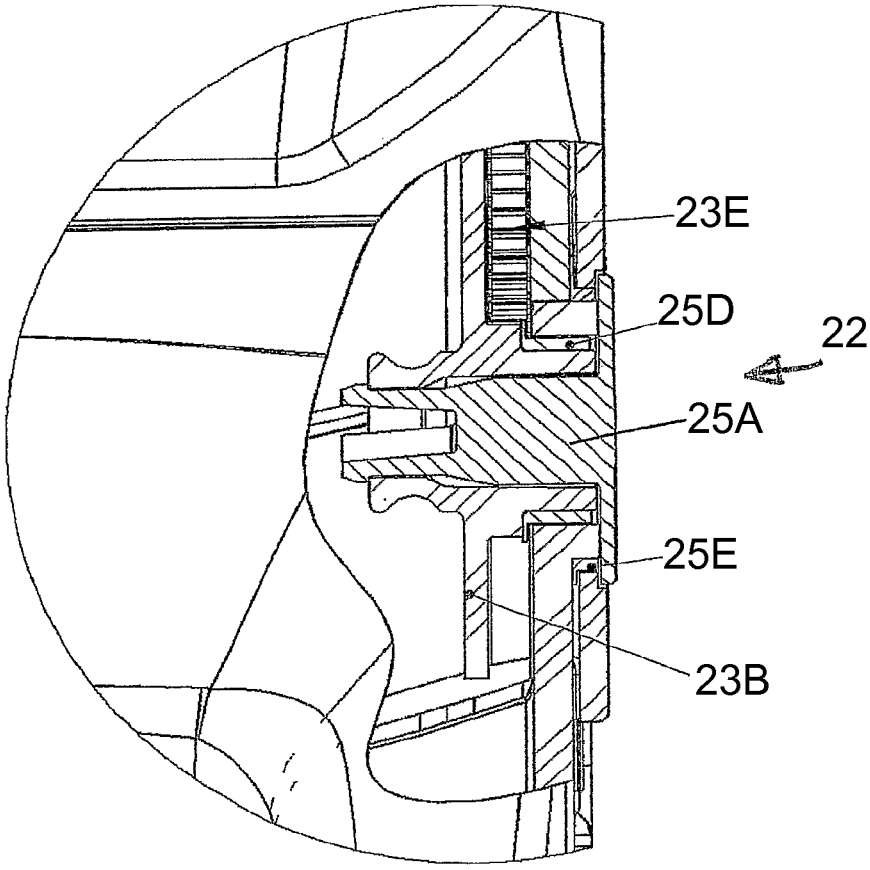
FIG. 16 is a perspective view of the gate means component.
Figure 18:
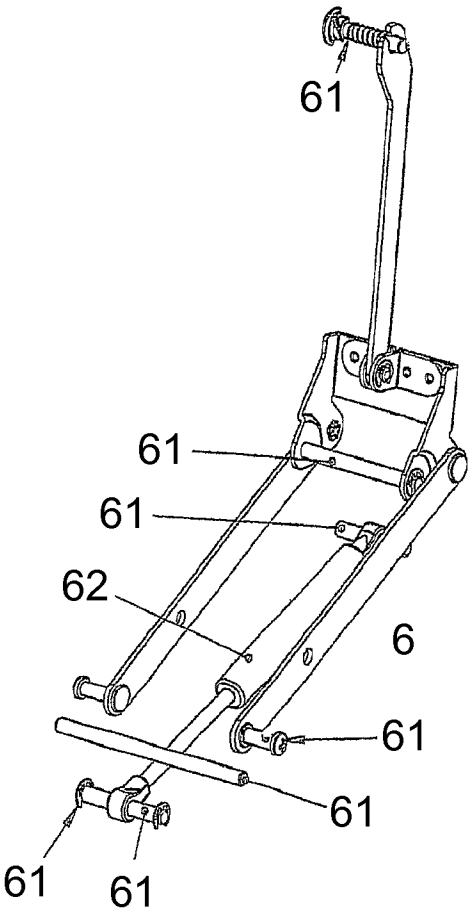
FIG. 18 is a perspective view of the support frame and moving means.
Figure 17:
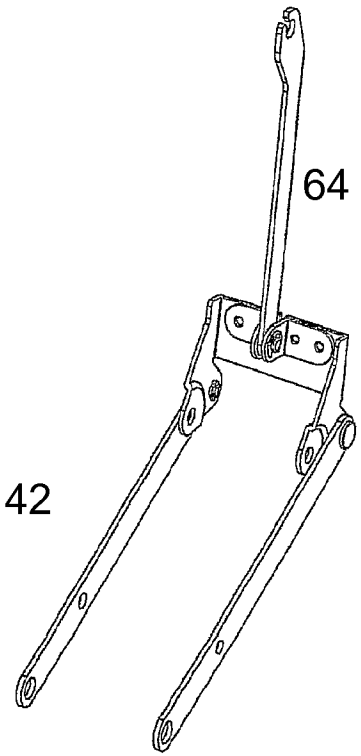
FIG. 17 is a perspective view of the support frame for the lift out arms of the apparatus.
Figure 19:
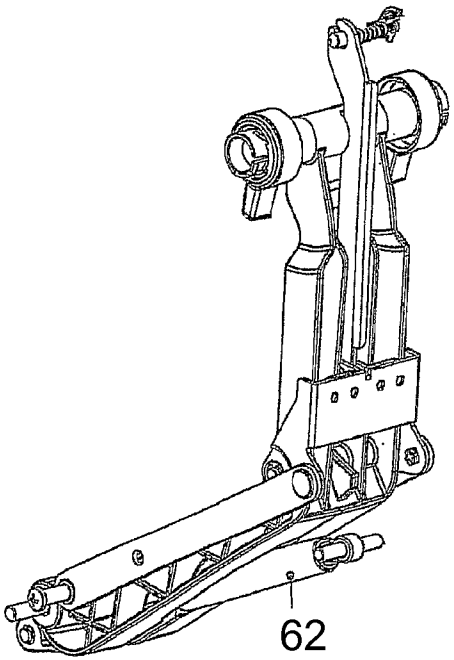
FIG. 19 is a rear perspective view of the support frame and moving means.
Figure 20:
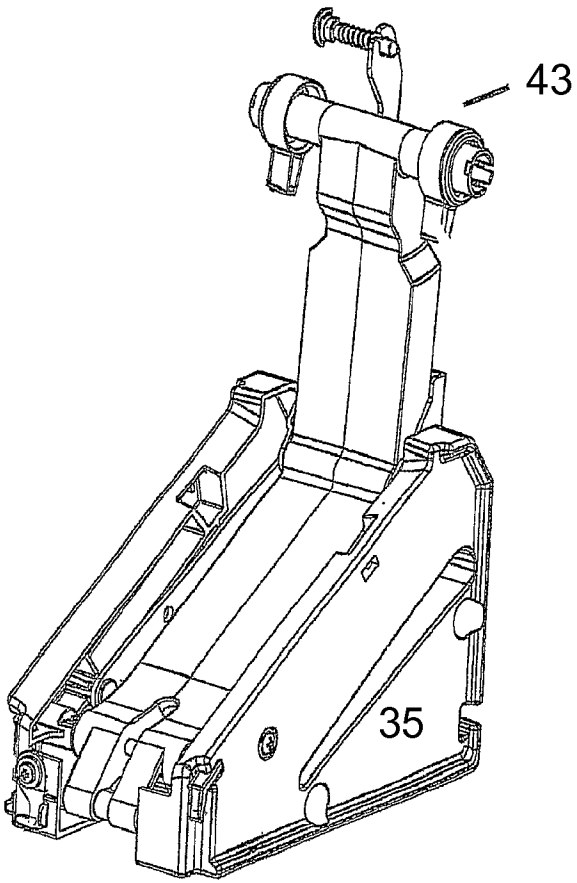
FIG. 20 is a front perspective view of the support frame and housing.

First rotating means 22 as shown in detail in FIG. 16 has a pin there through outer container tabs through chute tabs 20 and 21 and then through the gate arms 23B to finally rotatably hold a lower portion of the biasing means 23D which has the other end located at another upper fixed point on the inner side of the container wall. The lower end of the biasing means 23D is rotation fixed to the inner side of the gate arms 23B. This can include one side of the apparatus or both sides as required whereby in use when the chute means 17 is rotated the gate arms 23B rotate the lower end of the biasing means 23D to cause tension so that when the chute means is released the restorative force of the biasing means 23D is able to pull the chute back up to its relaxed position to thereby close the gate means 17 and prevent any dispensing therefrom apparatus.

The movement of the chute means 17 can also be enhanced by allowing the opening action or downwards operation to allow dispensing to selectively positions to vary the gate opening width and hence the flow of the dispensed product. In another variation the downward action may be sprung to allow the chute portion to automatically return to a closed position, with or without initiation.

The gate means 23 opens by travelling down but in other options this can be carried out in the opposite direction if desired.

Container supporting means 3 can include support portion 35 and extending portion 36 as shown FIGS. 2, 3 and 5-7. Support portion 35 is shaped to provide a surface to allow adequate stability and connection to allow the dispensing apparatus 1 to rest and be safely supported while allowing for any dispensing therefrom. Support portion 35 is also shaped to allow movable connection to the extending portion 36 and to allow a folded storage therein. In this example support portion 35 is shaped as a housing having a base 37, side portions 38, a front end 39 and rear end 40. Extending portion 36 comprises a first arm 41 rotatably connected to a second arm 42 which is then rotatably connected to the container 2 via a container rotation connection means 43 to rear container end 7.

In use the extending means base 37 is shaped and adapted to support the container 2 in a full or empty configuration so that the container 2 can be moved to allow filling and or dispensing therefrom whereby the arms 41 & 42 extend out and then fold together a whereby an arm portion 41 is housed in the base and another arm portion 42 is abutted behind the container 2 as shown in FIGS. 1 and 2. Various other components as shown and also as not shown are also included which allow the arms to move, rotate and support such as pivot shafts, hydraulic rams, gas struts, bushings and rollers.

In another alternative to the extending arms, there can be telescoping portions which can also function to both support and allow movement of the container to ground level. Alternatively there may be no extending arms whereby the container is merely located on a shelf or hung from a wall. In this example there may be no need for a supporting means or in yet another alternative combination there may be no supporting portion and only extending means.

As shown in FIG. 1 for each side of the container there are container tab, chute tab, gate arm, first rotating means 22 and second rotating means 23C to form and allow the measured movement of the chute means 17 in its rotation via the curved aperture or recess 46 having teeth or cogs located on at least edge.

The dispensing means can be fabricated from a variety of material and in any combination. In general various forms of plastics have been found to be the most suitable which can be see-through or opaque or be combined, with metal components where necessary. Various forms of labelling and/or advertising or pricing can also be attached to the container or be inserted in pockets 48.

Figure 6:
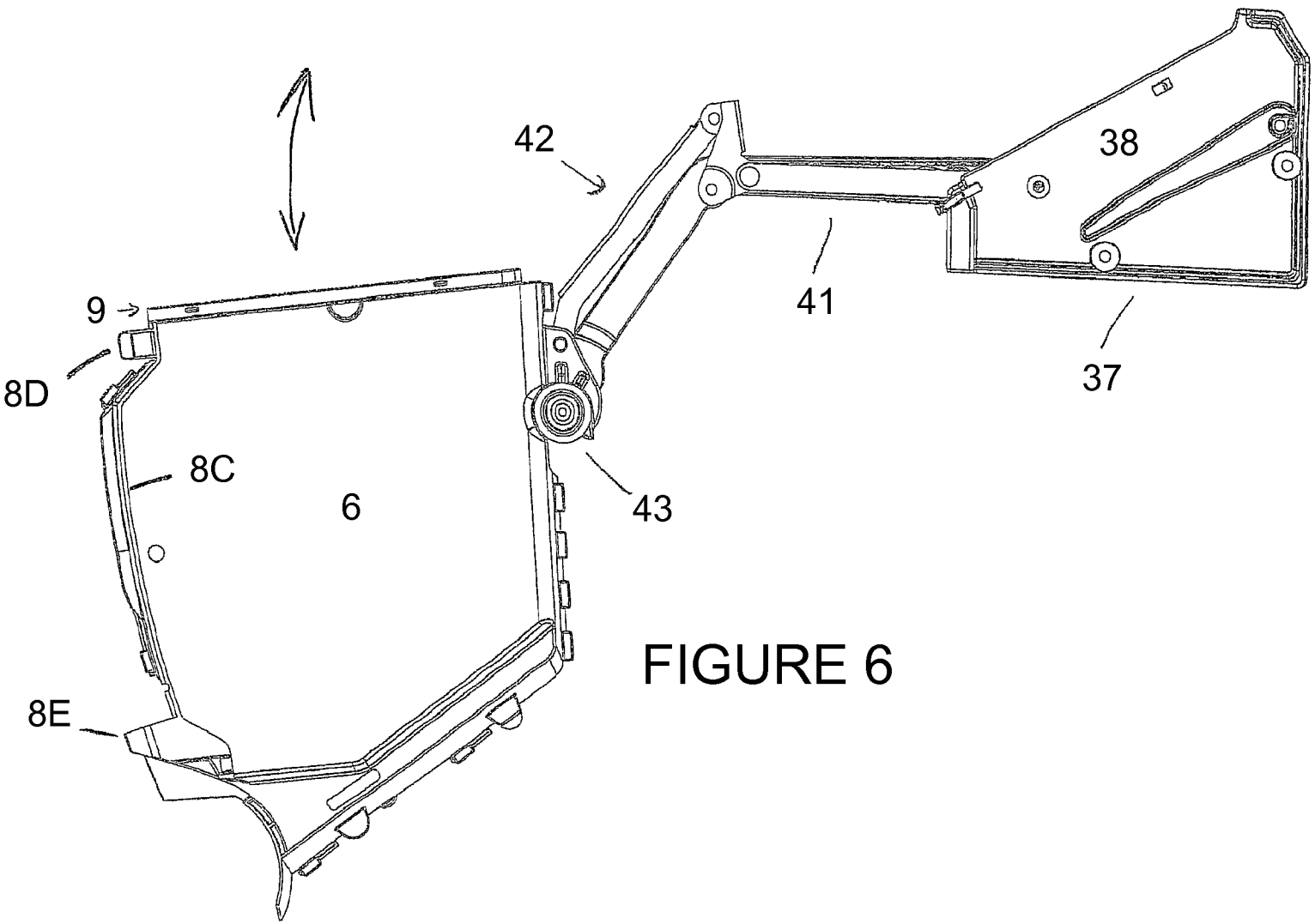
FIG. 6 is a side view of the dispensing apparatus in the extended mode without the lid and front portion.
Figure 7:
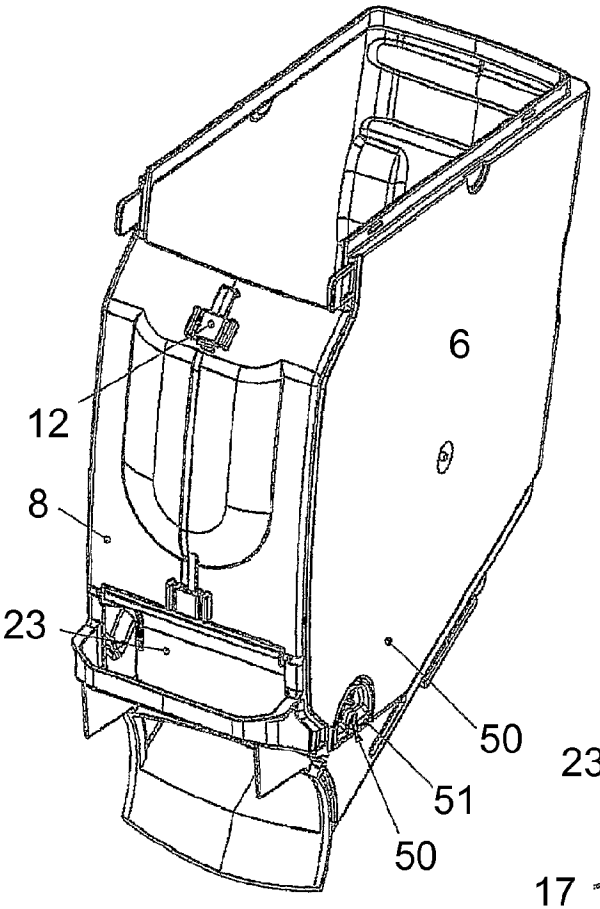
FIG. 7 is a perspective front end view of the dispensing apparatus in a second embodiment without the chute.

As shown in FIGS. 7 and 8 and 13-14 there is a front lock switch 50 which allows the dispenser to be deactivated or to not able to be used by locking the chute means 17 from any rotation. This includes a mechanism which comprises a half circle shaped rotating member having tab and cam portions to interact with a co-acting tab attached to the container 2. Also shown in these figures is a lock bar 54 which is a lever pivotally attached to the base 3 via the support arms to lock the container 2 and folding arms together from a folding position or non extending position. With the lock bar 54 rotated the container can be moved from the locked position of FIGS. 1-4 & 9 and 11 whereby the arms are extended as shown in FIGS. 5-7.

Chute means 17 is shown separately in FIGS. 11 and 12 whereby the chute means 17 can be conveniently formed as two parts 17A and 17B removably attached together about rotating means 22 whereby chute tabs 20 and 21 can be part of chute part 17B. To allow the chute means to be slidably fitted between the container tabs 15 and 16 respectively, the distance 17C between outer most surface of tabs 20 and 21 must be less.

Figure 10:
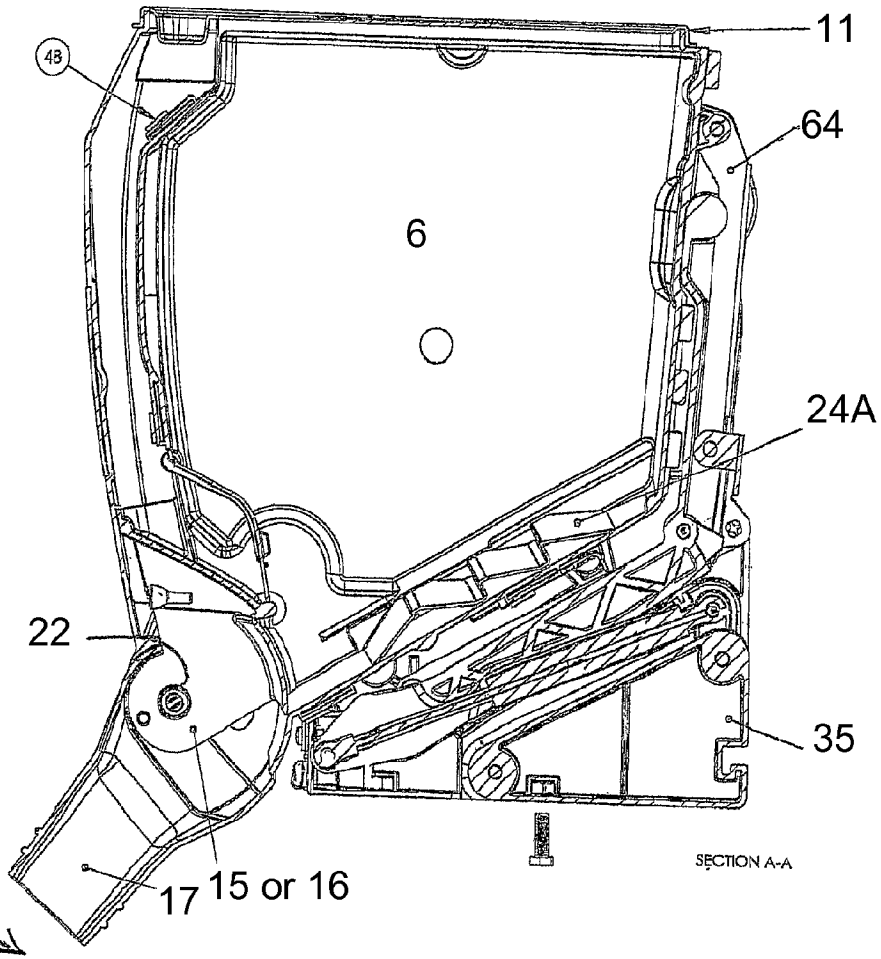
FIG. 10 is a side elevation of the apparatus of FIG. 8.

FIG. 16 is a close up view of the rotating means 22 and pivot means 25 and 26 as circled in FIG. 10 which includes a central pin 25A having a splayed end 25B with one arm 23B having a tubular sleeve portion 23C there-around. Sleeve portion 23C is grooved 25C to allow the biasing means to fit within to move the gate means with various sleeves between portions i.e. S sleeve 25D and L sleeve 25E.

Figure 5:
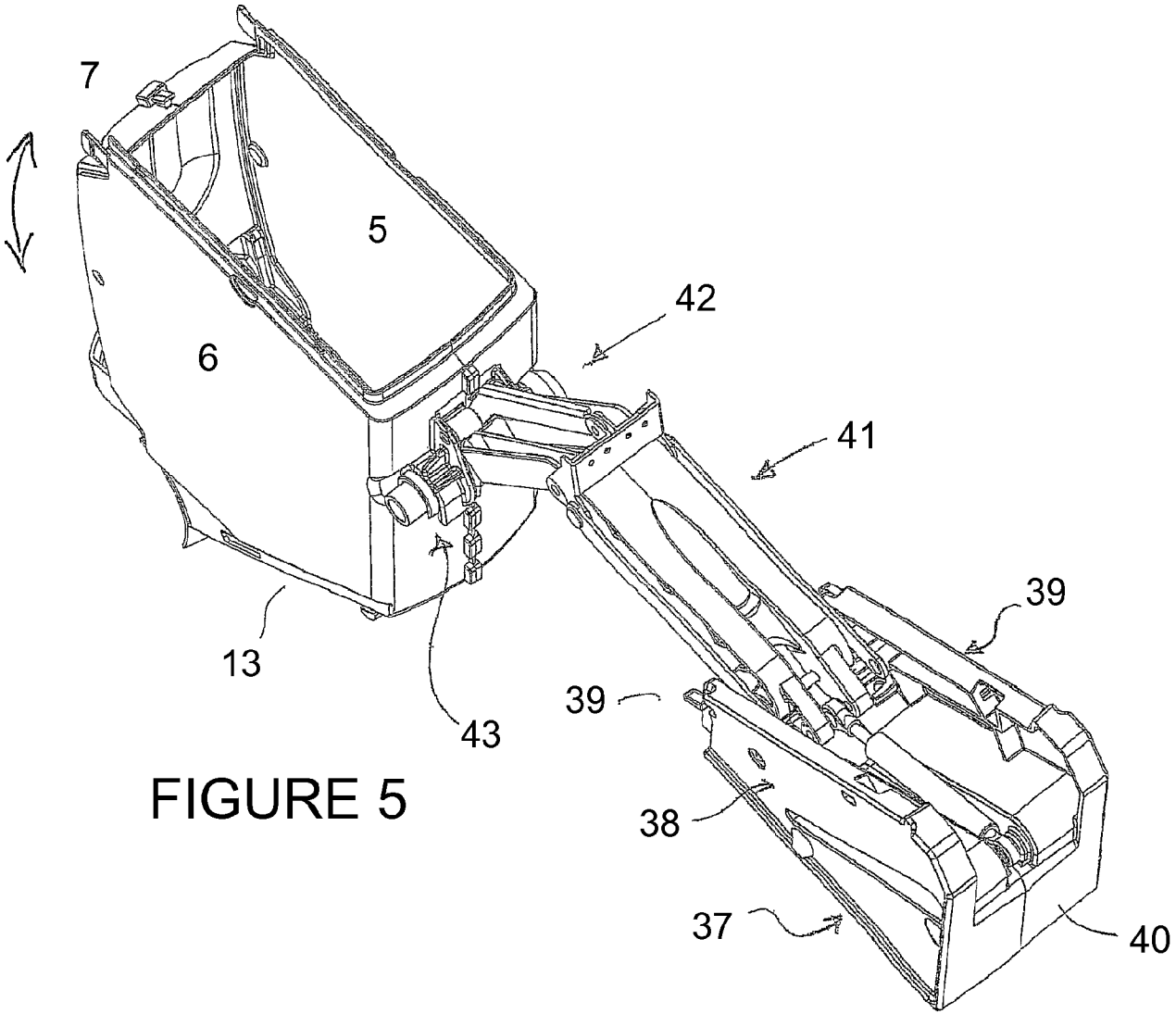
FIG. 5 is a similar upper perspective view of the dispensing apparatus as in FIG. 5.

FIGS. 17-20 show more detail of the container supporting means of FIGS. 5-7 whereby the extending portion 36 shows the folding arms 41 and 42 being formed as metal bars 60 with pins 61 to form a frame, with a gas strut 62 support said movement of the arms in a measured amount. The bars may be made of metal or plastic as is necessary to forfill it s use. Also such bars can be combined into or with box sections or any other shape or have different cross sections Also shown in more detail is the connection means 43 which also includes a pin member 63 and single central rotatably supporting end bar 64 with which is also rotatably supported and connected to arm 42.

ADVANTAGES a) Simpler operation.
b) Modest manufacturing costs.
c) Reduced jamming due to the contained food.
d) More efficient gravity feed.
e) Reduced maintenance.
f) Able to dispense with one hand.
g) Easier to refill apparatus.
h) Accessible adjustable rotating chute.
i) Hygienic dispensing.
j) Fewer components.
k) Able to be locked to prevent unwanted use.
l) Able to adjust agitating means without dismantling the apparatus.

Variations

Throughout the description of this specification, the word "comprise" and variations of that word such as "comprising" and "comprises", are not intended to exclude other additives, components, integers or steps. Though the products mentioned in this specification for use with this dispensing apparatus relate to any non fluid product such as grains or powder or any semi non fluid pourable product, various sealing means may be utilized with same principles as disclosed in this specification to dispense fluid type products as well.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

To those skilled in the art to which the invention relates, many changes in construction and widely differing embodiments and applications of the invention will suggest themselves without departing from the scope of the invention as defined in the appended claims. The disclosures and the description herein are purely illustrative and are not intended to be in any sense limiting.

Though the drawings show the toothed wheel 23C and biasing means 23D on both sides of the container there may be situations where only one wheel is required on one side of the container.

What we claim is:

1. A dispensing apparatus for gravity feeding of a dispensable product, the apparatus comprising:

a non-rotating container; and a rotatable dispenser, wherein the container is adapted to contain the dispensable product as contents and is operatively connected to the dispenser, the dispenser including a chute configured as a dispenser and an outlet for the dispensable product while maintaining a sealing containment of the contents at all times, the chute protruding out from the container, and being tubular with an entry end and an exit end, whereby an operable, manual rotation of the chute into a dispensing position is sufficient to cause a dispensing operation that dispenses, by gravity, the dispensable product from the container to the exit end of the chute for exiting the dispensing apparatus, wherein the chute is biasedly attached to the container to automatically return the chute to a closed position, whereby dispensing of the product is prevented, after completion of the dispensing operation, wherein the chute is operatively connected to a gate, wherein the chute includes a first rotatable member that permits rotation of the chute with respect to the container, and a second rotatable member comprising a toothed wheel located above the first rotatable member and rotationally affixed to the container, the chute and the gate, and configured to permit a limited rotation whereby, in use, rotation of the chute about the first rotatable member into the dispensing position causes the gate to move a predetermined distance to open the dispenser to permit dispensing of the dispensable product therefrom, wherein the gate comprises a U-shaped member that includes a base portion and arms, the base portion configured to block the entry end of the chute when the chute is in the closed position, and the arms being rotatably joined to the chute, wherein rotation of the chute about the first rotatable member and the second rotatable member causes the gate to rotate in a direction opposed to that of the chute, wherein the chute includes side tab portions extending upwardly from the entry end of the chute, the container and the chute being connected by way of said side tab portions, and wherein the arms of the U-shaped member of the gate are rotatably joined to said side tab portions of the chute.

2. The dispensing apparatus as claimed in claim 1, wherein the gate has a curved base portion and is rotatably mounted to the chute whereby, in use, the base portion of the gate slidably moves past a similarly curved portion of the chute to allow opening and closing of the chute.

3. The dispensing apparatus as claimed in claim 2, wherein an agitator is adapted to move and assist the dispensable contents to move when the dispenser is being activated or operated.

4. The dispensing apparatus as claimed in claim 3, wherein the agitator comprises an adjustable arm located externally to the container, whereby the agitator can be operatively caused to move upwards or downwards.

5. The dispensing apparatus as claimed in claim 4, wherein the apparatus includes an extender being operatively connected and adapted to allow the container to be moved relative to a support to allow refilling or dispensing therefrom while the support remains stationary.

6. The dispensing apparatus as claimed in claim 5, wherein the extender comprises moveably rotatably connected and foldable arms which are connected to the support whereby the support is connected to the container.

7. The dispensing apparatus as claimed in claim 1, wherein the chute is biasedly connected to the container by way of a flexible resilient member configured to urge the chute into the closed position, and wherein the chute is configured to be operated by hand to act against a bias of the resilient member to rotate the chute to dispense the dispensable product, whereby in a single action by hand for rotating the chute directly and simultaneously causes a dispensing of the dispensable product.

8. The dispensing apparatus as claimed in claim 1, wherein the container is operatively connected to the dispenser by mechanical means only.

9. A dispensing apparatus for gravity feeding of a dispensable product, the apparatus comprising:

a non-rotating container; and a dispenser, wherein the container is adapted to contain the dispensable product as contents and is operatively connected to the dispenser, the dispenser including a chute configured as an outlet for the dispensable product while maintaining a sealing containment of the contents at all times, the chute protruding out from the container, and being tubular with an entry end and an exit end, whereby an operable, manual rotation of the chute to a dispensing position causes the dispensable product to be able to be dispensed by gravity from the container to the exit end of the chute for exiting the dispensing apparatus, wherein the chute is biasedly attached to the container to automatically return the chute to a closed position after completion of a dispensing operation thereby to stop dispensing of the dispensable product from the container, wherein the chute is operatively connected to a gate, wherein the chute includes a first rotatable member to allow rotation of the chute with respect to the container, and a second rotatable member comprising a toothed wheel located above the first rotatable member and rotationally affixed to the container, the chute, and the gate, and configured to permit rotation by only a fixed distance whereby an operative rotation of the chute about the first rotatable member from the closed position to the dispensing position causes, via the toothed wheel, the gate to move by a predetermined distance to open the dispenser permitting dispensing of the dispensable product from the container, and wherein the gate comprises a curved base portion and arms rotatably mounted to the chute whereby, in use, the base portion of the gate slidably moves past a similarly curved portion of the chute to allow opening and closing of the chute wherein the chute includes side tab portions extending upwardly from the entry end of the chute, the container and the chute being connected by way of said side tab portions, and wherein the arms of the gate are rotatably joined to said side tab portions of the chute.

10. The dispensing apparatus as claimed in claim 9, wherein an agitator is adapted to move and assist the dispensable contents to move when the dispenser is being activated or operated.

11. The dispensing apparatus as claimed in claim 10, wherein the agitator comprises an adjustable arm located externally to the container, whereby the agitator can be operatively caused to move upwards or downwards.

12. The dispensing apparatus as claimed in claim 11, wherein the apparatus includes an extender being operatively connected and adapted to allow the container to be moved relative to a support to allow refilling or dispensing therefrom.

13. The dispensing apparatus as claimed in claim 12, wherein the extender comprises moveably rotatably connected and foldable arms which are connected to the support whereby the support is connected to the container.

14. A dispensing apparatus for gravity feeding of a dispensable product, comprising:

a non-rotating container; and a dispenser, the container being adapted to contain the dispensable product as contents and operatively connected to the dispenser, the dispenser including a rotatable chute configured as an outlet for the dispensable product while maintaining a sealing containment of the contents, the chute, protruding out from the container, being tubular with an entry end and an exit end, the chute configured to rotate with respect to the container, a first operational position in rotation of the chute causing the dispensable product to be dispensed directly from the container by gravity to the exit end of the chute for exiting the dispenser, and a second operational position in rotation of the chute preventing dispensation of the dispensable product, an operation for dispensing the dispensable product being accomplished as a single operation via a rotation of the chute from the second operational position to the first operational position, wherein the chute is rotatably coupled to a gate that blocks the entry end of the chute when the chute is in the second position, the chute and the gate being coupled so that the rotation of the chute causes the gate to rotate and be displaced from the entry end of the chute, thereby permitting dispensing of the product from the container, and wherein the chute includes a biasing element attached to the container configured to apply a force against the chute to urge the chute into the second operational position, the biasing element comprising any of a spring or a tensioned member, wherein the gate comprises a base portion and arms extending from opposite ends of the base portion, the base portion configured to block the entry end of the chute when the chute is in the closed position, wherein the chute includes side tab portions extending upwardly from the entry end of the chute, the container and the chute being connected by way of said side tab portions, and wherein the arms of the gate are rotatably joined to said side tab portions of the chute.

15. The dispensing apparatus as claimed in claim 14, wherein the chute includes a first rotatable member that enables a rotation of the chute with respect to the container, and a second rotatable member comprising a toothed wheel located above the first rotatable member and rotationally affixed to the container, the chute and gate, an operational rotation of the chute about the first rotatable member causing the gate to move a set distance to either open or close the dispenser.

16. The dispensing apparatus as claimed in claim 15, wherein the base portion of the gate is curved, and wherein the base portion of the gate is configured to move slidably past a corresponding portion of the chute.

17. The dispensing apparatus as claimed in claim 16, further comprising:

an agitator configured to cause the dispensable contents to move when the dispenser is operated, the agitator comprising adjustable arms located externally to the container.

18. The dispensing apparatus as claimed in claim 16, further comprising:

an extender being operatively connected and configured to cause the container to be positioned in either of a refilling mode or dispensing mode, the extender comprising moveably and rotatably connected foldable arms, said arms being connected to a support, and the support being connected to the container.

19. The dispensing apparatus as claimed in claim 14, wherein a coupling between the chute and the gate causes, in response to an operative rotation of the chute in a first rotational direction, the gate to reversibly rotate in an opposite second rotational direction for displacing the gate.

* * * * *